US008776769B2

(12) United States Patent
Kajita

(10) Patent No.: US 8,776,769 B2
(45) Date of Patent: Jul. 15, 2014

(54) PLASMA IGNITION DEVICE

(75) Inventor: Yuji Kajita, Chita-gun (JP)

(73) Assignee: Denso Corporation, Kariya (JP)

( * ) Notice: Subject to any disclaimer, the term of this patent is extended or adjusted under 35 U.S.C. 154(b) by 1184 days.

(21) Appl. No.: 12/707,919

(22) Filed: Feb. 18, 2010

(65) Prior Publication Data

US 2010/0206277 A1 Aug. 19, 2010

(30) Foreign Application Priority Data

Feb. 19, 2009 (JP) ..... 2009-036549
Nov. 13, 2009 (JP) ..... 2009-259787

(51) Int. Cl.
*F02P 3/02* (2006.01)
*F02P 3/06* (2006.01)
*F02P 9/00* (2006.01)
*F02P 3/08* (2006.01)

(52) U.S. Cl.
CPC ..... *F02P 3/0846* (2013.01); *F02P 9/007* (2013.01)
USPC ..... 123/620; 123/596; 123/604; 123/605; 123/621

(58) Field of Classification Search
CPC ..... F02P 7/035; F02P 15/08; F02P 9/007; F02P 3/0876; F02P 3/0884; F02P 15/10; F02P 15/012; F02P 3/06; F02P 3/09; F02P 3/0442; F02N 11/08; F02D 2041/2003
USPC ..... 123/594, 596, 604, 605, 620, 621, 623, 123/650, 652, 653, 654, 655, 656, 634, 636, 123/638, 640, 641, 649, 622, 143 B, 600, 123/601, 609, 179.5
See application file for complete search history.

(56) References Cited

U.S. PATENT DOCUMENTS 4,029,072 A * 6/1977 Goto et al. ..... 123/287
4,369,756 A * 1/1983 Ezoe ..... 123/620

(Continued)

FOREIGN PATENT DOCUMENTS

JP S55-010051 1/1980
JP S56-101075 8/1981

(Continued)

OTHER PUBLICATIONS

Japanese Office Action dated May 1, 2012, issued in corresponding Japanese Application No. 2009-259787 with English translation.

*Primary Examiner* — Hai Huynh
*Assistant Examiner* — Raza Najmuddin
(74) *Attorney, Agent, or Firm* — Nixon & Vanderhye PC

(57) ABSTRACT

The plasma ignition device includes an ignition plug, a breakdown discharge circuit configured to apply a high voltage to the ignition plug to cause a breakdown discharge in a discharge space in the ignition plug, and a plasma discharge circuit configured to accumulate electric energy supplied from a power supply and applies the accumulated electric energy to the ignition plug as a current to bring a gas in the discharge space into a plasma state so that the gas in the plasma state is injected to a combustion chamber of an combustion engine during the breakdown discharge in order to cause ignition. The plasma discharge circuit includes an energy accumulating section, and an energy supplying section configured to supply the electric energy to the energy accumulating section during a short time period immediately before the breakdown discharge circuit applies the first voltage to the ignition plug.

10 Claims, 18 Drawing Sheets

(56) References Cited

U.S. PATENT DOCUMENTS

| | | | | | |
|---|---|---|---|---|---|
| 4,369,758 | A * | 1/1983 | Endo | 123/620 | |
| 4,398,526 | A * | 8/1983 | Hamai et al. | 123/606 | |
| 4,407,259 | A * | 10/1983 | Abo | 123/620 | |
| 4,558,685 | A * | 12/1985 | Ishikawa et al. | 123/620 | |
| 4,619,241 | A * | 10/1986 | Yoshinari | 123/620 | |
| 4,739,185 | A * | 4/1988 | Lee et al. | 307/106 | |
| 4,996,967 | A * | 3/1991 | Rosswurm et al. | 123/598 | |
| 5,704,321 | A * | 1/1998 | Suckewer et al. | 123/143 B | |
| 6,131,542 | A * | 10/2000 | Suckewer et al. | 123/143 B | |
| 6,553,981 | B1 * | 4/2003 | Suckewer et al. | 123/620 | |
| 7,827,954 | B2 * | 11/2010 | Nagasawa et al. | 123/143 B | |
| 8,096,276 | B2 * | 1/2012 | Aida et al. | 123/143 B | |
| 8,316,823 | B2 * | 11/2012 | Sato et al. | 123/406.19 | |
| 8,387,580 | B2 * | 3/2013 | Aida et al. | 123/143 B | |
| 2008/0141967 | A1 | 6/2008 | Tani et al. | | |
| 2009/0007893 | A1 | 1/2009 | Kato et al. | | |
| 2011/0106395 | A1 * | 5/2011 | Aida et al. | 701/102 | |
| 2011/0239998 | A1 * | 10/2011 | Aida et al. | 123/620 | |

FOREIGN PATENT DOCUMENTS

| | | |
|---|---|---|
| JP | S57-099272 | 6/1982 |
| JP | S58-025581 | 2/1983 |
| JP | 3-264772 | 11/1991 |
| JP | 6-066236 | 3/1994 |
| JP | 6-196248 | 7/1994 |
| JP | 2000-511263 | 8/2000 |
| JP | 2006-294257 | 10/2006 |
| JP | 2008-177142 | 7/2008 |
| JP | P2009-030593 A | 2/2009 |

* cited by examiner

IN LOW TO MIDDLE RANGE

PLASMA IGNITION DEVICE

CROSS-REFERENCE TO RELATED APPLICATION

This application is related to Japanese Patent Applications No. 2009-36549 filed on Feb. 19, 2009, and No. 2009-259787 filed on Nov. 13, 2009, the contents of which are hereby incorporated by reference.

BACKGROUND OF THE INVENTION

1. Field of the Invention

The present invention relates to a plasma ignition device used for an ignition-difficulty combustion engine.

2. Description of Related Art

In recent years, fuel lean and high-supercharge combustion engines for vehicles have been steadily progressed in order to reduce environmental load substance contained in exhaust gas and to further improve fuel efficiency. Generally, since fuel lean combustion engines and high-supercharge combustion engines are relatively difficult to ignite, there is a strong demand for an ignition device which improves the ignition performance of such engines.

To address this demand, there are proposed various plasma ignition devices as next-generation ignition devices configured to inject a gas in a high-temperature and high-pressure plasma state into a combustion chamber to assure stable ignition operation in the fuel lean combustion engines or high-supercharge combustion engines having difficulty in igniting by use of a conventional spark plug. For example, refer to Published Japanese Translation No. 2000-511263 of PCT International Publication, or Japanese Patent Application Laid-open No. 2006-294257, or Japanese Patent Application Laid-open No. 2008-177142.

Such plasma ignition devices have a structure in which a high voltage is applied between a pair of opposed electrodes of an ignition plug defining a discharge space therebetween to cause a breakdown discharge therein by breaking down the insulation in this discharge space, the breakdown discharge triggering supply of a large current into the discharge space so that the gas in the vicinity of a discharge path formed by the breakdown discharge is brought to the plasma state, followed by the combustion chamber being injected with fuel to generate a flame core of large volume in the combustion chamber.

For example, the conventional plasma ignition device 1*z* shown in FIG. 17 includes an ignition plug 10*z*, a brake discharge circuit 30*z* to apply a high voltage to the ignition plug 10*z*, a plasma discharge circuit 40*z* to supply a large current to the ignition plug 10*z*, and an ECU (Electronic Control Unit) 60*z* to generate an ignition signal to control the breakdown discharge circuit 30*z* and the plasma discharge circuit 40*z* in accordance with the running state of a combustion engine.

The breakdown discharge circuit 30*z* includes a step-up coil 31*z* to step up a voltage of a power supply 20*z*, a step-up coil drive circuit including a switching element 32*z* to open and close the step-up coil 31*z*, a rectifying element 33*z* to rectify a current flowing from the step-up coil 31*z* to the ignition plug 10*z*, and a noise-absorbing resistor 34*z* to absorb high-frequency noise generated when ignition is carried out.

The plasma discharge circuit 40*z* includes a capacitor Cz to accumulate electrical energy supplied from the power supply 20*z*, a charge resistor 411*z* to limit a current flowing from the power supply 20*z* to the capacitor Cz to an appropriate value, and a large-capacity rectifying element 430*z* to rectify a plasma discharge current discharged from the capacitor Cz.

The voltages supplied to the breakdown discharge circuit 30*z* and the plasma discharge circuit 40*z* are adjusted to appropriate values by a voltage-regulating circuit 22*z* such as a DC/DC converter.

When an ignition switch 21*z* is closed, the low voltage supplied from the power supply 20*z* is applied to the primary side of the step-up coil 31. When a primary current Iprz is interrupted by the switching element 32*z* in accordance with the ignition signal IGtz outputted from the ECU60*z*, a high secondary voltage Vscz (10-30 kV, for example) is generated at the secondary side of the step-up coil 31*z* in the direction to prevent change of the magnetic flux in the step-up coil 31*z*.

When the secondary voltage Vscz exceeds the withstand voltage in the discharge space defined in the ignition plug 10*z*, there occurs a breakdown discharge, breaking down the insulation in the discharge space. Subsequently, triggered by this breakdown discharge, the electrical energy accumulated in the capacitor Cz is discharged into the discharge space as a large current, as a result of which the gas in the discharge space is injected into the combustion chamber in a high-temperature and high-pressure plasma state. Since the gas in the plasma state, which is large in volume, generates a frame core of high energy and high combustion speed, the above plasma ignition device is expected to stably ignite air-fuel mixture in the combustion chamber of an ignition-difficulty combustion engine.

Further, the above plasma ignition device is expected to perform stable ignition operation in not only an internal combustion engine of a vehicle, but also a cogeneration system for generating power using gas fuel.

However, the above conventional plasma ignition device 1*z* has a problem in that if the charge voltage Vcz of the capacitor Cz is set below a relatively low voltage, below 400 V, for example, discharge from the capacitor Cz does not start unless the discharge voltage applied from the breakdown discharge circuit 30*z* to the ignition plug 10*z* after insulation breakdown decreases below 400 V.

Since the discharge current flowing from the breakdown discharge circuit 30*z* to the ignition plug 10 is as small as below 100 mA, the interelectrode voltage of the ignition plug 10 having a negative resistance does not become below 400 V stably.

Accordingly, as shown in FIG. 18A, since the discharge voltage after insulation breakdown may become higher than 400 V before discharge from the capacitor Cz is started due to pressure variation in the discharge space, there may occur the so-called plasma-dropout phenomenon in which no discharge from the capacitor Cz occurs. If the plasma-dropout phenomenon occurs, since no large current is supplied from the capacitor Cz into the discharge space, there is a possibility that the gas in the discharge space is not injected into the combustion chamber causing misfire, preventing the in-cylinder pressure CYL from increasing.

If the charge voltage Cvz of the capacitor Cz is set to a high voltage, above 800 V, for example, since the interelectrode voltage of the ignition plug after insulation breakdown is stably below 800 V because of a discharge current from the breakdown discharge circuit 30*z*, a discharge from the capacitor Cz is started without fail, causing the gas in the plasma state within the discharge space to be injected into the discharge space.

However, in this case, since the ignition plug 10*z* is in a state of always being applied with the relatively high voltage, if the in-cylinder pressure decreases due to opening and closing of the discharge valve and the inlet valve of the engine, or descent of the piston of the engine as a result of which the insulation resistance in the discharge space decreases, there may occur the so-called false discharge irrespective of the ignition signal IGtz as shown in FIG. 18B.

Since such a false discharge causes a large current to flow from the capacitor Cz, the electrodes of the ignition plug may be worn out rapidly. Further, such a false discharge causes energy waste. Further, when a false discharge occurs during an air inlet period, the engine may be broken down due to early ignition.

Incidentally, if the charge voltage of the capacitor Cz is set between 400 V and 800 V, either the plasma plasma-dropout phenomenon or a false discharge may occur indeterminately depending on the running state of the engine.

In addition, to set the charge voltage of the capacitor Cz above 800 V to prevent the plasma-dropout phenomenon, it is necessary to provide insulation for ensuring safety around high voltage sections. For example, a high-withstand voltage cable and high-withstand voltage connectors have to be used for connection between the DC/DC converter 22*z* and the plasma discharge circuit 40*z*, and a high-withstand voltage capacitor of large capacitance has to be used as the capacitor Cz. This increases the size of the plasma ignition device, making it difficult to be mounted on a vehicle.

Although cogeneration systems generally have a large installation space which allows installation of a plasma ignition device large in size including a large capacitor to accumulate plasma energy, if the capacitor is applied with a high voltage for a long time period, a false discharge may occur due to change of the insulation withstand voltage of the discharge space caused by pressure variation in the combustion chamber.

SUMMARY OF THE INVENTION

The present invention provides a plasma ignition device comprising:

an ignition plug mounted on an combustion engine;

a breakdown discharge circuit configured to generate a first voltage by stepping up a first power supply voltage and apply the generated first voltage to the ignition plug to cause a breakdown discharge in a discharge space in the ignition plug; and a plasma discharge circuit configured to accumulate electric energy supplied from a power supply and apply the accumulated electric energy to the ignition plug as a current to bring a gas in the discharge space into a plasma state so that the gas in the plasma state is injected to a combustion chamber of the combustion engine during the breakdown discharge to cause ignition;

wherein the plasma discharge circuit includes an energy accumulating section, and an energy supplying section configured to supply the electric energy to the energy accumulating section during a time period immediately before the breakdown discharge circuit applies the first voltage to the ignition plug.

According to the present invention, there is provided a plasma ignition device for an ignition-difficulty combustion engine, which is compact in size and easy to mount on the engine, and is capable of preventing the plasma-dropout phenomenon and a false discharge from occurring.

Other advantages and features of the invention will become apparent from the following description including the drawings and claims.

PREFERRED EMBODIMENTS OF THE INVENTION

First Embodiment

Figure 1:
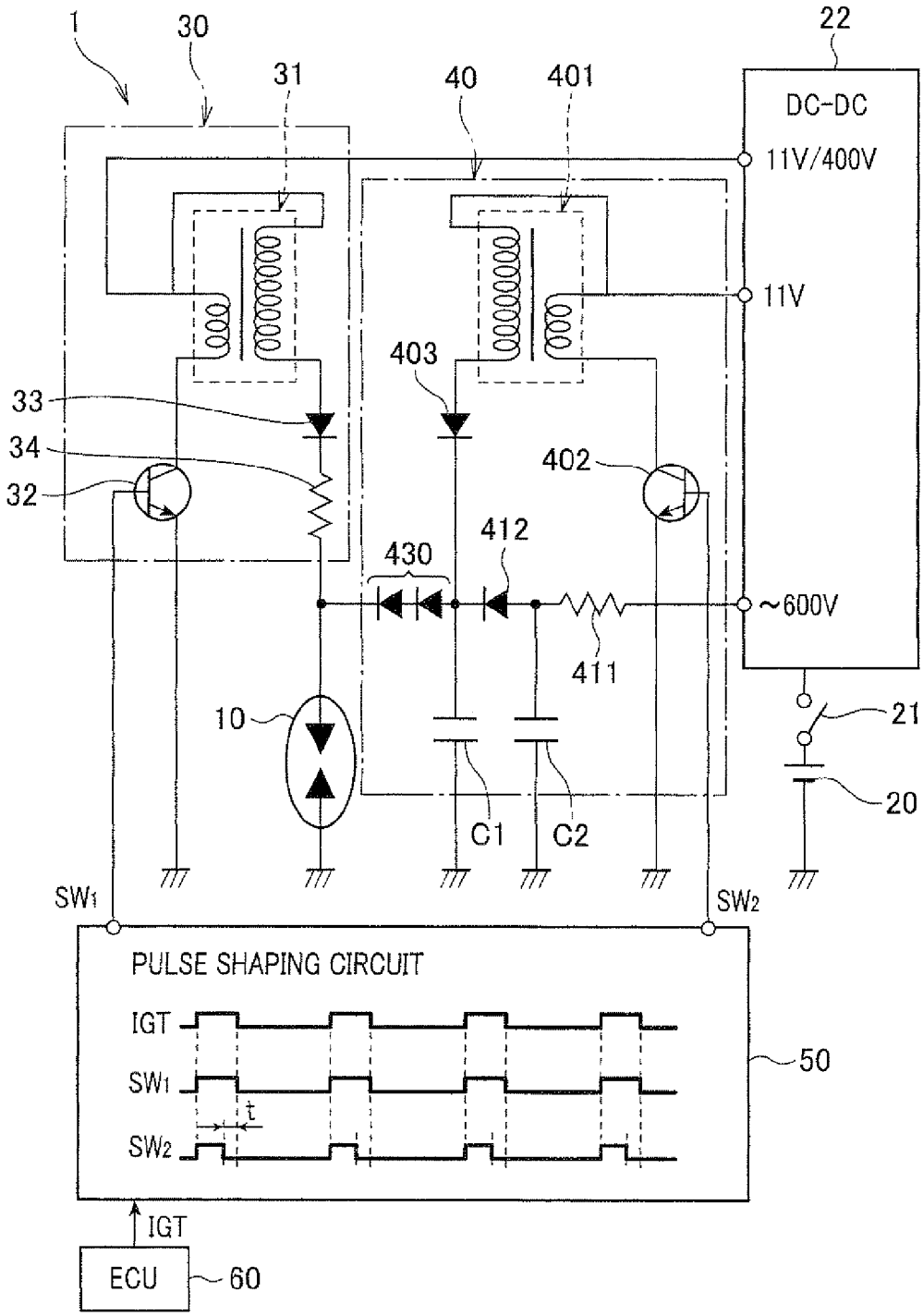
FIG. 1 is a circuit diagram of a plasma ignition device 1 of a first embodiment of the invention.
Figure 2:
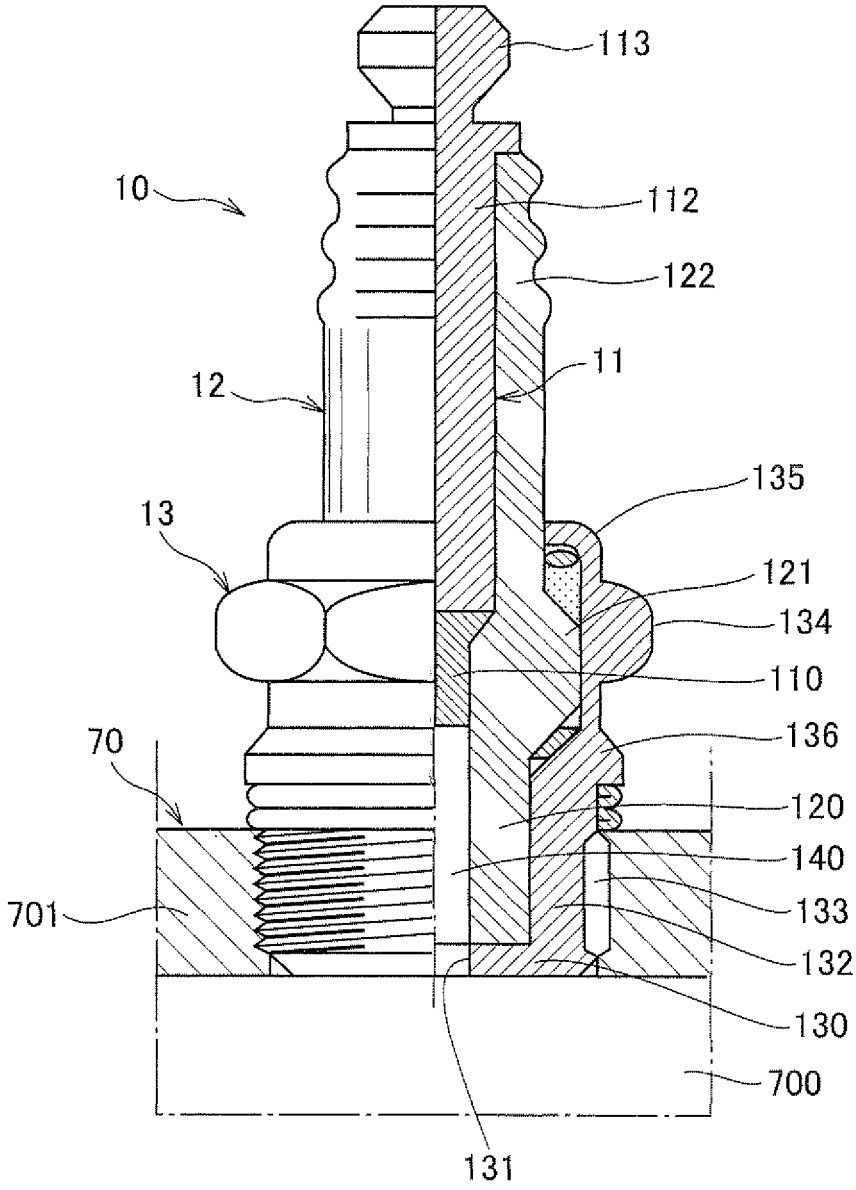
FIG. 2 is a partially cut cross-sectional view of an ignition plug 10 included in the plasma ignition device 1.

FIG. 1 is a circuit diagram of a plasma ignition device of a first embodiment of the invention. FIG. 2 is a partially cut cross-sectional view of an ignition plug 10 included in the plasma ignition device 1.

As shown in FIG. 1, the plasma ignition device 1 includes the ignition plug 10 mounted to an internal combustion engine (not shown), a breakdown discharge circuit 30 to apply a high voltage generated by stepping up the voltage of a power supply 20, a plasma discharge circuit 40 to accumulate electrical energy received from the power supply 20 and supply the accumulated electrical energy to the ignition plug 10 as a large current, a pulse shaping circuit 50, and an electronic control unit (referred to as an ECU hereinafter) 60.

The breakdown discharge circuit 30 includes a step-up coil 31 to generate a breakdown discharge voltage, a step-up coil drive circuit including a switching element 32 to open and close the step-up coil 31, a rectifying element 33 to rectify the secondary current of the step-up coil 31, and a noise absorbing resistor 34.

The step-up coil 31 includes primary and secondary coils. One terminal of the primary coil of the step-up coil 31 is connected to the power supply 20 through a DC/DC converter 22 and an ignition key 21, and the other terminal is grounded through the switching element 32.

In this embodiment, a coil whose inductance is in a range from 1 mH to 10 mH is used as the primary coil of the step-up coil 301, and a coil whose inductance is in a range from 5 H to 50 H is used as the secondary coil. The secondary coil is wound around the secondary spool disposed along the outer periphery of the center core of the step-up coil 31. The primary coil is wound around the primary spool disposed along the outer periphery of the center core of the step-up coil 31. An outer core is provided along the outer peripheries of the primary and secondary coils. The center core and the outer core, which are made of laminations of silicon steel plates, constitute closed or open magnetic circuit. The primary and secondary spools are made of resin in a cylindrical shape.

Figure 7:
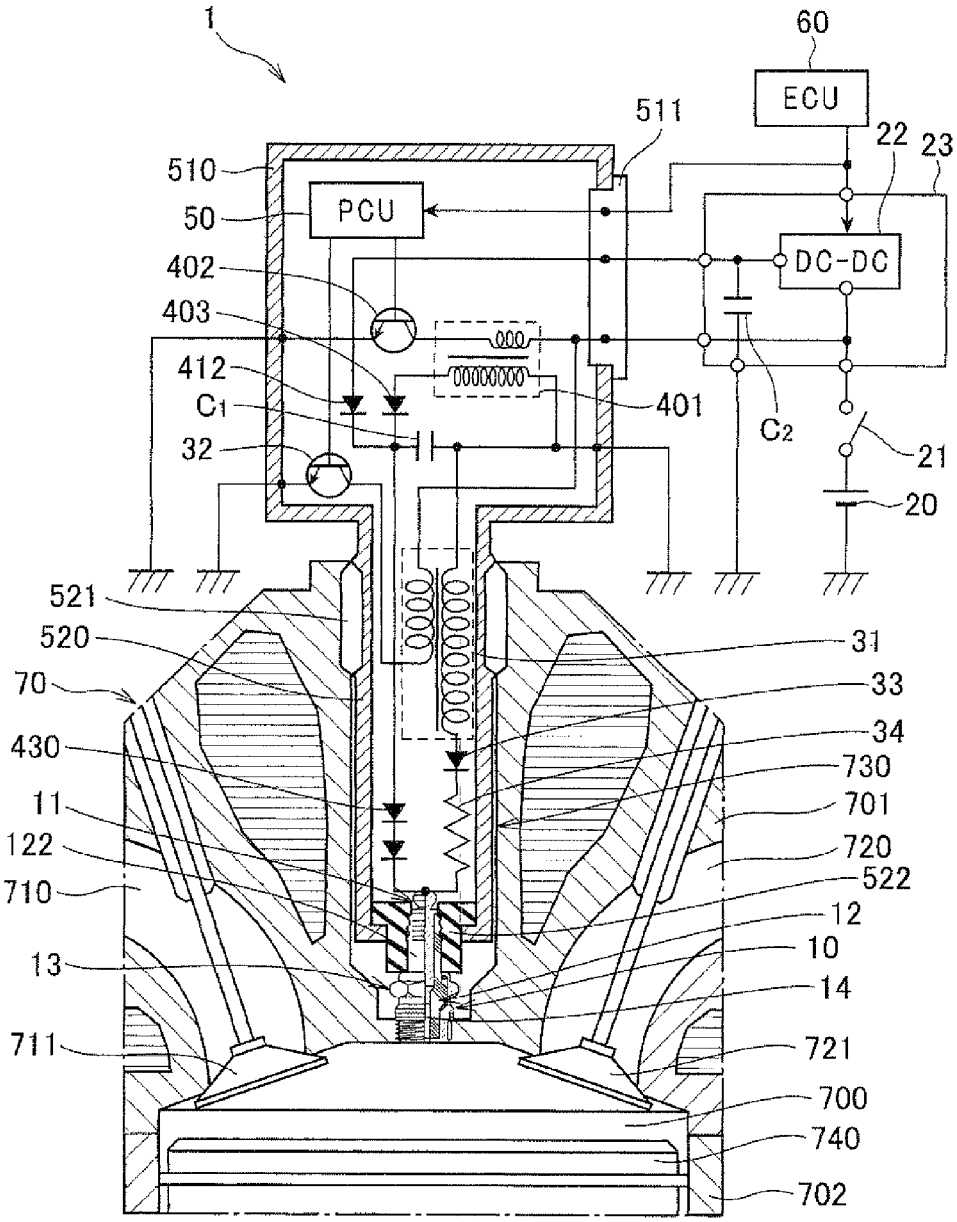
FIG. 7 is a diagram showing the electrical structure of the plasma ignition device 1 mounted to the engine.

One terminal of the secondary coil of the step-up coil 31 is connected to the ignition plug 10 through the rectifying element 33 and the noise absorbing resistor 34, and the other terminal is connected to the power supply side terminal of the primary coil. The other terminal may be grounded as shown in FIG. 7.

The primary coil of the step-up coil 31 may be directly applied with the voltage (11 V, for example) of the power supply 20, or alternatively, may be applied with a stepped-up voltage (400 V, for example) generated by a voltage regulating circuit (referred to as the DC/DC converter) 22 disposed between the step-up coil 31 and the power supply 20. When the DC/DC converter 22 is provided, since the voltage step-up ratio of the step-up coil 31 needs not to be large, the step-up coil 31 can be made compact in size.

The rectifying element 33 rectifies the secondary current of the step-up coil 31 and prevents a current discharged from the plasma discharge circuit 40 from flowing back to the step-up coil 31. The noise absorbing resistor 34 absorbs the high-frequency noise occurring when ignition is carried out to prevent the high-frequency noise from leaking to the outside.

The plasma discharge circuit 40 includes capacitors $C_1$ and $C_2$, a step-up coil 401, a step-up coil drive circuit including a switching element 402, and rectifying elements 403, 412 and 430. The capacitor $C_1$ and the capacitor $C_2$ whose capacitance is smaller than the capacitor $C_1$ both serve as energy accumulating means. The step-up coil 401 steps up the voltage of the power supply 20 to charge the capacitor $C_1$ instantaneously as an instantaneous energy supply means. The step-up coil driver circuit including the switching element 402 opens and closes the primary coil of the step-up coil 401. The rectifying element 403 rectifies the secondary current of the step-up coil 401. The charge resistor 411 regulates a current supplied from the power supply 20 to charge the capacitor $C_2$. The rectifying element 412 rectifies a current discharged from the capacitor $C_2$. The rectifying element 430 rectifies a current flowing from the capacitors $C_1$ and $C_2$ to the ignition plug 10.

As shown in FIG. 7, the charge resistor 411 may be removed when the DC/DC converter 22 is on/off controlled in accordance with an IGt signal outputted from the ECU 60.

The step-up coil 401 includes primary and secondary coils. One terminal of the primary coil of the step-up coil 401 is connected to the power supply 20 through the DC/DC converter 22 and the ignition key 21, and the other terminal is grounded thorough the switching element 402. One terminal of the secondary coil of the step-up coil 401 is connected to one terminal of the capacitor $C_1$ through the rectifying element 403, the other terminal of the capacitor $C_1$ being grounded. The rectifying element 403 rectifies the secondary current of the step-up coil 401 and prevents current flowing from the capacitors $C_1$ and $C_2$ from flowing back to the step-up coil 401. The other terminal of the secondary coil of the step-up coil 401 is connected to the power supply side terminal of the primary coil. The other terminal of the secondary coil of the step-up coil 401 may be grounded as shown in FIG. 7.

In this embodiment, a coil whose inductance is in a range from 1 mH to 10 mH is used as the primary coil of the step-up coil 401, and a coil whose inductance is in a range from 1 H to 50 H is used as the secondary coil of the step-up coil 401. The secondary coil is wound around the secondary spool disposed along the outer periphery of the center core of the step-up coil 401. The primary coil is wound around the primary spool disposed along the outer periphery of the center core. An outer core is provided along the outer peripheries of the primary and secondary coils. The center core and the outer core, which are made of laminations of silicon steel plates, respectively constitute a closed or open magnetic circuit. The primary and secondary spools are made of resin in a cylindrical shape.

Between one terminal of the capacitor $C_2$ and the power supply 20, the charge resistor 411 and the DC/DC converter 22 are disposed to step up the voltage of the power supply 20 and applies the stepped-up voltage to the capacitor $C_2$. The other terminal of the capacitor $C_2$ is grounded. The capacitors $C_1$ and $C_2$ are connected in parallel to each other through the rectifying element 412. The capacitor $C_1$ is connected with the ignition plug 10 through the rectifying element 430 at its downstream side.

The rectifying element 412 rectifies a current discharged from the capacitor $C_2$, and prevents currents discharged from the breakdown discharge circuit 30, and the capacitors $C_1$ and $C_2$ from flowing back to the capacitor $C_2$. The rectifying element 430 rectifies currents discharged from the capacitors $C_1$ and $C_2$, and prevents the breaking high voltage below 40 KV generated by the breakdown discharge circuit 30 from being applied to the plasma discharge circuit 40.

In this embodiment, a capacitor having a withstand voltage of 2.5 kV and a relatively small capacitance (between 0.01 μF and 0.1 μF) is used as the capacitor $C_1$ which is applied with a high voltage between 800 V and 1.3 kV, while a capacitor having a withstand voltage of 1 kV and a relatively large capacitance (between 0.5 μF and 5 μF) is used as the capacitor $C_2$ which is applied with a relatively low voltage below 600 V. The step-up coils 31 and 401 respectively emit discharge energy of 35 mJ, for example.

In view of a small installation space of a vehicle, it is preferable that the capacitors $C_1$ and $C_2$ have different capacitances as is the case of this embodiment, however, the capacitors $C_1$ and $C_2$ may have the same capacitance when the plasma ignition device 1 is used for an cogeneration system where its engine has a relatively large installation space for installing an ignition device.

A SCR (thyristor), a MOSFET (metal oxide field effect transistor), or an IGBT (insulated gate bipolar transistor) may be used as the switching element 32 or 402 depending on the primary current of the step-up coil 31 or 401 and the required response characteristic. As the switching element 32 or 402, an element whose withstand voltage is relatively low can be used, because they are disposed on the primary sides of the step-up coil 31 or 401. In this embodiment, the switching element 32 is connected to the primary side of the step-up coil 31 at its anode, or collector, or drain, and grounded at its cathode, or emitter or source. Likewise, the switching element 402 is connected to the primary side of the step-up coil 401 at its anode, or collector, or drain, and grounded at its cathode, of emitter or source.

The rectifying elements 33, 403, 412 and 430 may be a diode type rectifying element. It is preferable that a power diode made of a wide band gap type semiconductor such as a SiC semiconductor is used as the rectifying elements 412 and 430 which are required to pass a large current.

In this embodiment, the rectifying elements 33, 403, 412 and 430 are disposed such that their anodes are located on the side of the center electrode of the ignition plug 10, and their cathodes are located on the side of the ground electrode of the ignition plug in order to reduce wear of the center electrode. However, they may be disposed such that their anodes are located on the side of the ground electrode, and their cathodes are located on the side of the center electrode depending on the shape of the ignition plug 10 and the types of the engine.

Control terminals of the switching elements 32 and 402 are connected to the pulse shaping circuit 50.

In order to control the switching elements 32 and 402 such that they are turned on and off at appropriate timings in accordance the ignition signal IGt which the ECU 60 generates in accordance with the running state of the engine, the pulse shaping circuit 50 generates an open/close signal $SW_1$ as a pulse signal of a shaped waveform to on/off control the switching element 32, and generates an open/close signal $SW_2$ as a pulse signal of a shaped waveform to on/off control the switching element 402.

Here, the structure of the ignition plug 10 used in the plasma ignition device 1 of this embodiment is briefly explained with reference to FIG. 2. However, although the first embodiment having the structure in which the discharge space is provided in the ignition plug 10 provides significant advantageous effects, it should be understood that the present invention is not limited to the ignition plug having the below described structure.

The ignition plug 10 includes a center electrode 11 made of conductive metal material and having an elongated shape, an insulator 12 of a tubular shape covering the outer periphery of the center electrode 11, a housing 13 made of metal and having a tubular shape holding the insulator 12, and aground electrode 130 having a ring shape extending from the front end of the housing 13.

The center electrode 11 includes a backbone section 112, and a discharge section 110 connected to the backbone section 112 and disposed at the front end side of the center electrode 11. The backbone section 112 is made of a highly electrically conductive and highly thermally conductive metal material such as steel or copper. The discharge section 110 is made of heat-resistant conductive material such as iridium or an iridium alloy and formed in a shape of a thin line. The backbone section 112 is formed with a terminal section 113 to be connected to the power supply 20 at its base end side.

The insulator 12, which ensures electrical insulation between the terminal section 113 and the housing 13, is made of high-purity alumina excellent in thermal resistance, mechanical strength, high-temperature insulation resistance, and thermal conductivity. The insulator 12, which covers the outer periphery of the center electrode 11, includes a base section 120 of a tubular shape extending downward from the front end of the discharge section 110 at is front end side, a large-diameter section 121 swaged to the inner side of the housing 13 at its intermediate side, and an insulator head section 122 of a corrugate shape at its base end side. Inside the base section 120 of the insulator 12, a discharge space 140 is provided to enable discharge between the discharge section 110 and the ground electrode 130.

The housing 13 includes a base section 132 of a tubular shape to cover the base section 120 of the insulator 12. The base section 132 of the housing 13 is formed with a thread section 133 for screw connection with the engine at its outer periphery, a lock section 136 to hold the large-diameter section 121 of the insulator 12 at its base end side, and a hexagonal section 134 for screwing the thread section 133 at the outer periphery on the base end side of the housing 13. The large-diameter section 121 of the insulator 12 is swaged by a swage section 135 of the housing 13.

The ground electrode 130 is formed in a ring shape having an opening 131 communicating with the discharge space 140. The housing 13 including the ground electrode 130 is made of metal material such as nickel or iron. The ignition plug 10 is mounted to a cylinder head 701 such that the opening 131 of the ground electrode 130 opens to a combustion chamber 700 of the engine 70, and the ground electrode 130 is electrically connected to the cylinder head 701.

Next, the operation and effects of the plasma ignition device 1 of the first embodiment are explained with reference to FIGS. 3 and 4.

Figure 3:
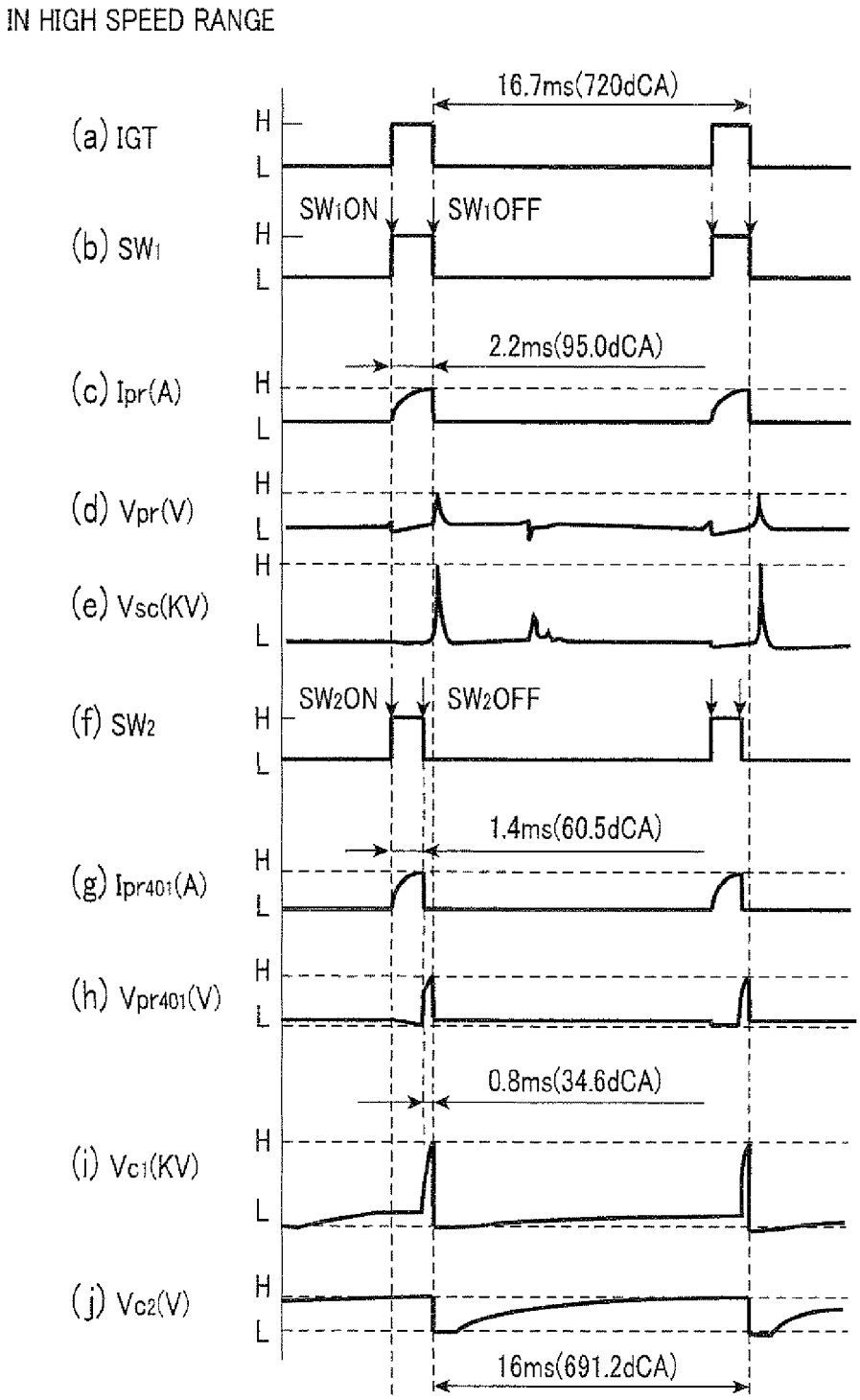
FIG. 3 is a time chart showing timings of various signals in the plasma ignition device 1 when an internal combustion engine to which the plasma ignition device 1 is mounted runs in a high speed range.
Figure 4:
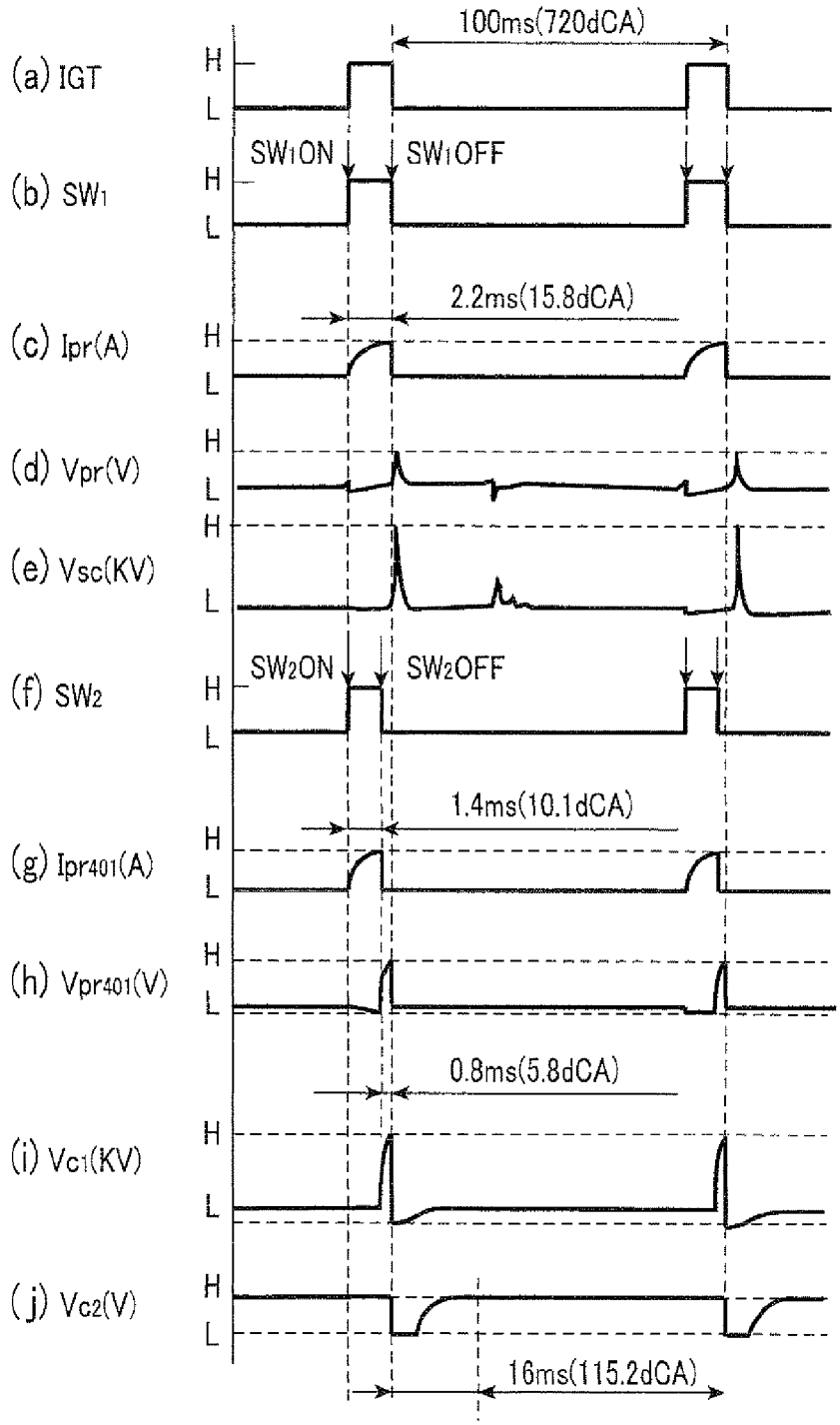
FIG. 4 is a time chart showing timings of various signals in the plasma ignition device 1 when the engine runs in a low to middle speed range.
Figure 5:
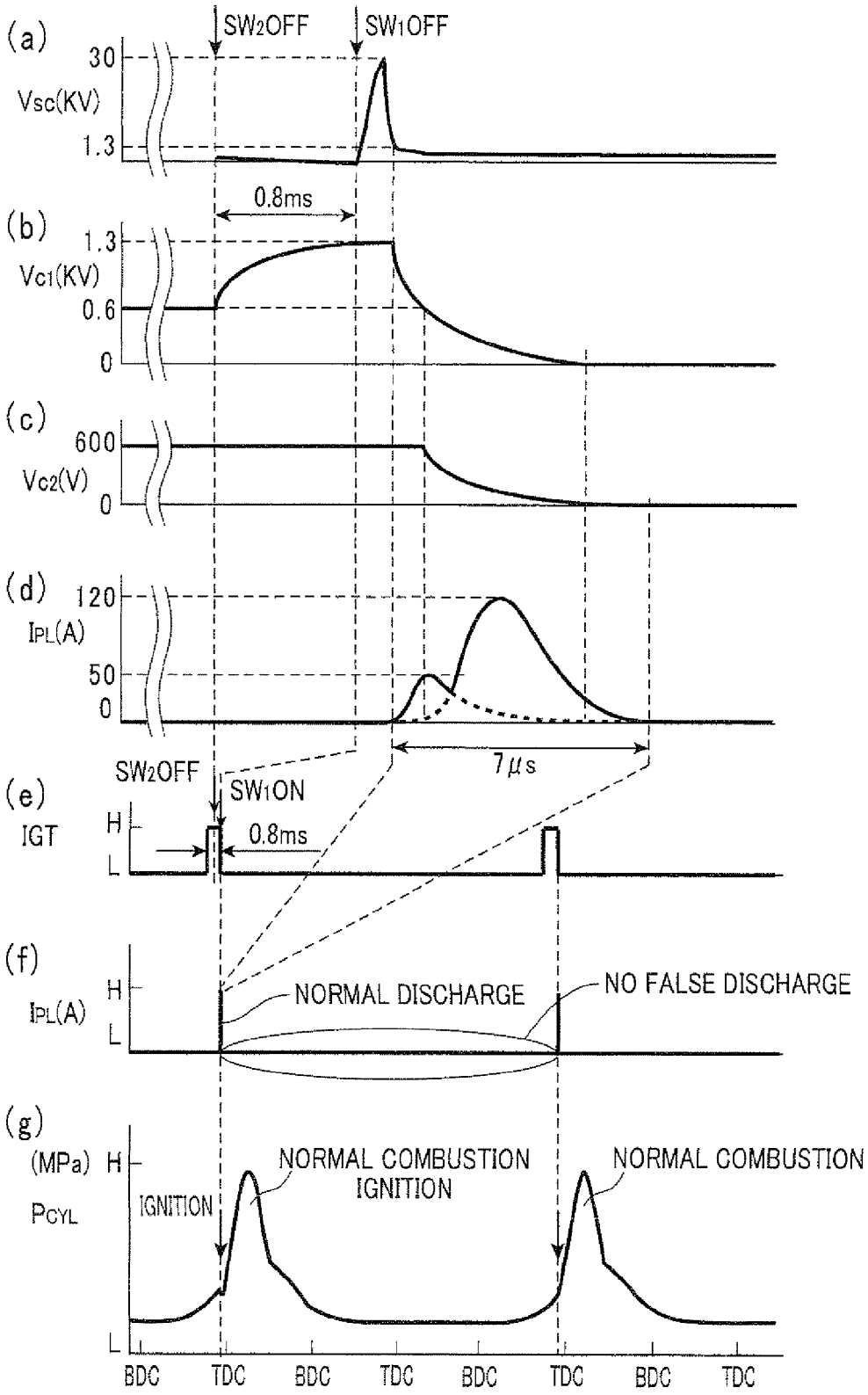
FIG. 5 is a time chart for explaining advantages of the plasma ignition device 1.

FIGS. 3 and 4 are timing charts of various signals in the plasma ignition device 1 used for the vehicle engine 70 when it runs in a high speed range (7200 rpm, for example) and in a low to middle speed range (1200 rpm, for example), respectively. FIG. 5 is a time chart for explaining the advantages provided by the plasma ignition device 1 of the first embodiment. Incidentally, since the time charts shown in FIGS. 3 to 5 are for schematically showing the features of the first embodiment, their horizontal and vertical axes are not linear.

In FIGS. 3 and 4, (a) shows occurrence timings of the ignition signal IGt generated by the ECU 60, (b) shows turn-on and turn-off timings of the open/close signal $SW_1$, (c) shows variation with time of the primary current Ipr of the step-up coil 31, (d) shows variation with time of the primary voltage Vpr of the step-up coil 31, (e) shows variation with time of the secondary voltage Vsc of the step-up coil 31, (f) shows turn-on and turn-off timings of the open/close signal $SW_2$, (g) shows variation with time of the primary current $Ipr_{401}$ of the step-up coil 401, (h) shows variation with time of the secondary voltage $Vpr_{401}$ of the step-up coil 401, (i) shows variation with time of the secondary voltage Vsc of the step-up coil 401 as the charge voltage $V_{C1}$ to charge the capacitor $C_1$, and (j) shows variation with time of the charge voltage $V_{C2}$ to charge the capacitor $C_2$.

The ECU 60 generates the ignition signal IGt depending on the running state of the engine as shown in (a) of FIG. 3 and FIG. 4, the pulse shaping circuit 50 applies the open/close signal $SW_1$ to the switching element 32 at the timings adjusted in accordance with the ignition signal IGt as shown in (b) of FIG. 3 and FIG. 4, and the step-up coil 31 accumulates magnetic energy when the open/close signal $SW_1$ is turned on causing the primary current Ipr to flow from the power supply 20 to the step-up coil 31 as shown in (c) of FIG. 3 and FIG. 4. In this embodiment, it takes around 2.2 ms to charge the primary coil of the step-up coil 31.

Thereafter, when the switching element 32 is turned off in accordance with the open/close signal $SW_1$ causing the primary current Ipr to change, the primary voltage Vpr of the order of several hundred volts is generated at the primary coil of the step-up coil 31 as shown in (d) of FIGS. 3 and 4, as a result of which the secondary voltage Vsc in a range from 10 kV to 40 kV is generated at the secondary coil of the step-up coil 31 as shown in (e) of FIGS. 3 and 4. When this secondary voltage Vsc exceeds the insulation withstand voltage of the electrodes opposed across the discharge space of the ignition plug 10, the insulation of the discharge space is broken down, causing a breakdown discharge.

On the other hand, the pulse shaping circuit 50 applies the open/close signal $SW_2$ to the switching element 402 at the timings adjusted in accordance with the ignition signal IGt as shown in (f) of FIG. 3 and FIG. 4, and the step-up coil 401 accumulates magnetic energy when the open/close signal $SW_2$ is turned on causing the primary current $Ipr_{401}$ to flow from the power supply 20 to the step-up coil 401 through the DC/DC converter 22 as shown in (g) of FIG. 3 and FIG. 4. In this embodiment, it takes around 1.4 ms to charge the primary coil of the step-up coil 401.

Thereafter, when the switching element 402 is turned off in accordance with the open/close signal $SW_2$ causing the primary current of the step-up coil 402 to change abruptly, the primary voltage $Vpr_{401}$ of the order of several hundred volts is generated at the primary coil of the step-up coil 402 as shown in (h) of FIGS. 3 and 4, as a result of which the secondary voltage $Vsc_{401}$ in a range from 800 V to 2 kV is generated at the secondary coil of the step-up coil 402. As shown in (i) of FIGS. 3 and 4, the capacitor $C_1$ is charged with this secondary voltage $Vsc_{401}$. Incidentally, it was found that the charge voltage $V_{C1}$ to charge the capacitor $C_1$ can be increased to around 1.3 kV in a short time period of about 0.8 ms by using a capacitor having a high withstand voltage and a small capacitance as the capacitor $C_1$, and charging this capacitor $C_1$ with the high secondary voltage $Vsc_{401}$ stepped up by the step-up coil 401.

On the other hand, the capacitor $C_2$ is applied with a voltage of several hundred volts outputted form the DC/DC converter 22, and is fully charged to a constant voltage in a time period of about 16 ms as shown in (j) of FIGS. 3 and 4.

Incidentally, as shown in FIG. 3, when the engine is running at a high speed, 7200 rpm, for example, and the ignition cycle period is 16.7 ms, since charging of the capacitor $C_2$ is completed in a period of time of about 16 ms, it does not occur that the capacitor is $C_2$ is in an insufficiently charged state when the capacitor $C_2$ starts a discharge. On the other hand, as shown in FIG. 4, when the engine is running at a low speed, 1200 rpm, for example, charging of the capacitor $C_2$ is completed also in a period of time of about 16 ms, and the capacitor is kept at a constant voltage thereafter.

In FIG. 5, (a) shows variation with time of the secondary voltage Vsc of the step-up coil 31 along the magnified horizontal axis (time axis), (b) shows in detail variation with time of the charge voltage $V_{C1}$ of the capacitor $C_1$ along the magnified horizontal axis (time axis), (c) shows in detail variation with time of the charge voltage $V_{C2}$ of the capacitor $C_2$ along the magnified horizontal axis (time axis), (d) shows in detail variation with time of the plasma discharge current $I_{PL}$ along the magnified horizontal axis (time axis), (e) shows occurrence timings of the ignition signal IGt, shows variation with time of the plasma discharge current $I_{PL}$ during one cycle period the ignition signal IGt, and (g) shows variation with time of the combustion pressure $P_{CYL}$.

As shown in FIG. 5, in this embodiment, immediately before the open/close signal $SW_1$ is turned off to apply the high secondary voltage Vsc generated by the step-up coil 31 to the ignition plug 10, the open/close signal $SW_2$ is turned off causing the capacitor $C_1$ to be charged instantaneously (in 0.8 ms, for example) while the capacitor $C_2$ is charged to the relatively low charge voltage $V_{C2}$ (600 V, for example). Accordingly, since the high voltage is applied to the capacitor $C_1$ only for a very short time period after the open/close signal $SW_2$ is turned off and immediately before the open/close signal $SW_1$ is turned off, and a moment at which the open/close signal $SW_1$ is turned off, there is no possibility that the so-called false discharge occurs even when the combustion pressure $P_{CYL}$ becomes low, as shown in (f) of FIG. 5.

When the open/close signal $SW_1$ is turned off as a result of which the high secondary voltage Vsc generated by the step-up coil 31 is applied to the ignition plug 10 causing the insulation to be broken down, a breakdown discharge occurs, and a discharge from the capacitor $C_1$ is started at the moment when the interelectrode voltage (the voltage between the center electrode 11 and the ground electrode 130) falls below the charge voltage $V_{C1}$ of the capacitor $C_1$. As a result, the gas in the discharge space 140 is excited, and a large current starts to flow from the capacitor $C_2$ when the interelectrode voltage further falls below the charge voltage $V_{C2}$ of the charge voltage $V_{C2}$ of the capacitor $C_2$, causing the gas in the discharge space 140 having been brought into the high-pressure and high-temperature plasma state to be injected into the combustion chamber followed by firing.

Unlike the conventional ignition device in which a large current of the order of 100 A is flown at a stroke from the plasma discharge circuit 40*z* following a breakdown discharge of a small discharge current of the order of 100 mA, this embodiment is configured such that following a breakdown discharge from the step-up coil 31, the discharge path is maintained by causing the plasma current IP of the order of 50 A to flow from the capacitor $C_1$ charged to the high charge voltage $V_{C1}$, and thereafter, discharge of the plasma current $I_{PL}$ from the plasma discharge circuit 40 is started at a relatively low voltage by causing a large current of the order of 120 A to flow from the capacitor $C_2$ charged to the relatively low charge voltage $V_{C2}$ as shown in (d) of FIG. 5. As a result, the plasma current $I_{PL}$ starts to flow at a relatively high voltage from the plasma discharge circuit 40 causing the interelectrode voltage of the ignition plug 10 having a negative resistance to decrease, which enables passing a current stably from the capacitor $C_2$, and accordingly maintaining the discharge path without causing the so-called plasma-dropout phenomenon.

The high secondary voltage $Vsc_{401}$ of the step-up coil 401 is built up only during a specific time period immediately before a breakdown discharge from the breakdown discharge circuit 30 occurs. Since the insulation withstand voltage between the center electrode and the ground electrode is sufficiently high during this specific time period, no false discharge occurs even when the secondary voltage $Vsc_{401}$ of the step-up coil 401 is directly applied to the ignition plug 10, and this voltage is used only to charge the capacitor C.

The most significant feature of this embodiment is in that the plasma discharge circuit 40 includes two capacitors $C_1$ and $C_2$, and the capacitor $C_1$ higher in charge voltage and smaller in capacity than the capacitor $C_2$ is charged with a high voltage which the step-up coil 402 generates in accordance with on/off operation of the switching element 402, so that the capacitor $C_1$ can be fully charged to the high voltage in a short time period immediately before ignition without causing a false discharge. This enables stably supplying a plasma current from the low-voltage and large-capacitance capacitor $C_2$, because the interelectrode voltage falls due to the discharge current flowing from the capacitor preventing the plasma-dropout phenomenon and also preventing a false discharge by limiting the time period during which the high voltage is applied to the ignition plug 10.

In the above embodiment, the open/close signal $SW_1$ and the open/close signal $SW_2$ are turned on at the same time, however, they may be turned on at different timings. Also, the timing at which the on/off signal $SW_2$ is turned off is not limited to the one described in this embodiment.

Although the above embodiment requires that the capacitor $C_1$ is fully charged with the high voltage which the step-up coil 401 generates in accordance with the open/close signal $SW_2$ at a timing immediately before a breakdown discharge starts in accordance with the ignition signal IGt, this timing may be varied depending on the time necessary for the primary coil of the step-up coils 31 to be fully charged, the time necessary for the primary coil of the step-up coils 401 to be fully charged, the time necessary for the capacitor $C_1$ to be fully charged, the characteristics of the switching elements 32 and 402, and the type and size of the engine, if the capacitor $C_1$ can be fully charged immediately before a breakdown discharge starts.

In the following, the structure and advantages of the plasma ignition device 1 of this embodiment are explained in more detail.

Figure 6:
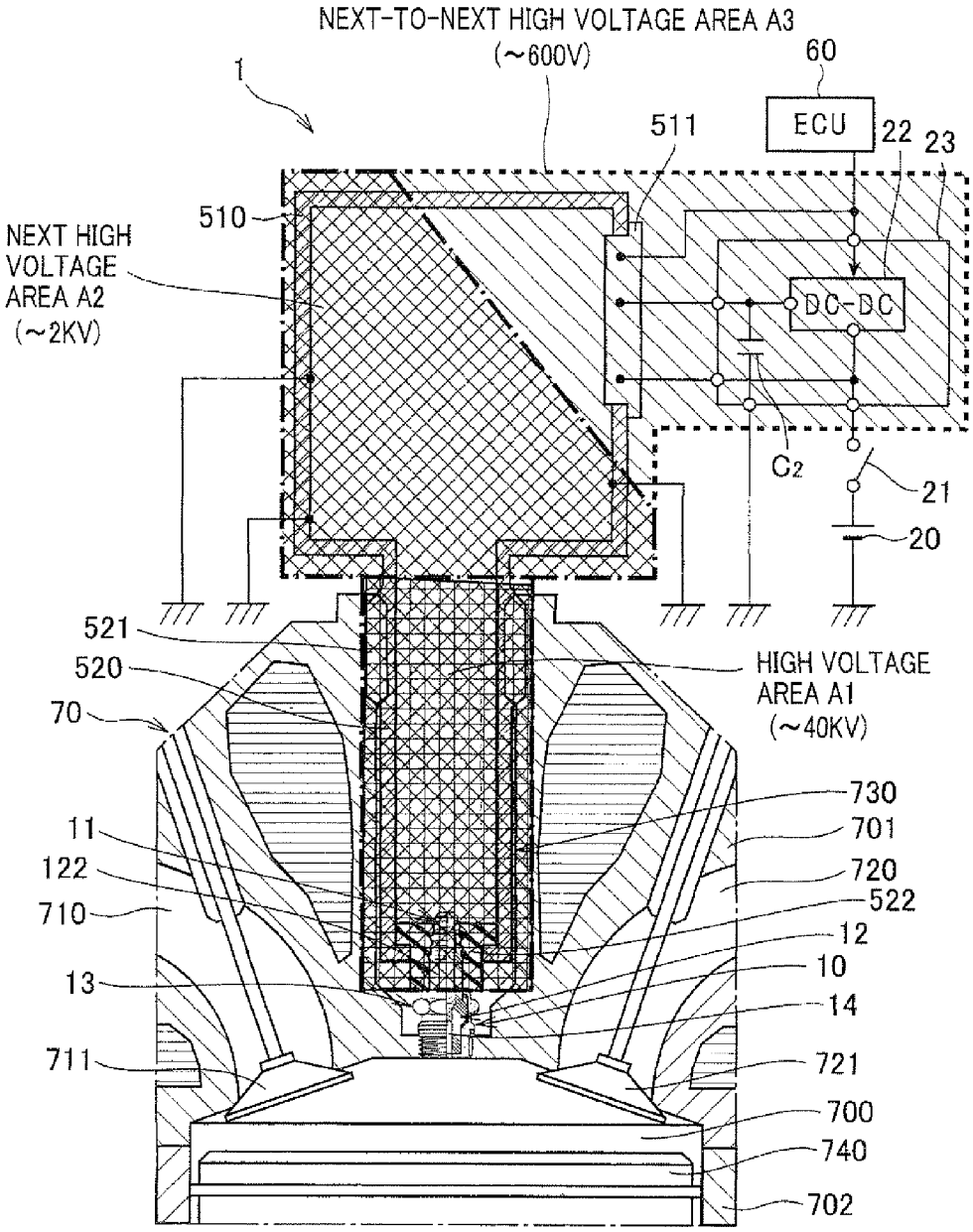
FIG. 6 is a cross-sectional view of the plasma ignition device 1 schematically explaining the design insulation levels of the plasma ignition device 1.

As shown in FIG. 6, the combustion engine 70 to which the plasma ignition device 1 is mounted has the structure in which a combustion chamber 700 is defined by a cylinder head 701, a cylinder 702 and a piston 740 which moves up and down in the cylinder 702, the cylinder head being provided with an inlet tube 710 and an discharge tube 720, the inlet tube 710 being opened and closed by an inlet valve 711, the discharge tube 720 being opened and closed by a discharge valve 721, the ignition plug 10 being fitted in a plug hole 730 formed in the cylinder head 701.

Further, as shown in FIG. 6, the plasma ignition device 1 is sectioned into a high voltage area $A_1$ required to have a withstand voltage of 40 kV, a next high voltage area $A_2$ required to have a withstand voltage of 2.5 kV, and a next-to-next high voltage area $A_3$ required to have a withstand voltage of 600 V.

By configuring the plasma ignition device 1 such that components applied with higher voltage are disposed closer to the ignition plug 10 so that the plasma ignition device 1 can be sectioned into different areas provided with insulation measures of different levels, it is possible to reduce design insulation levels stepwise, to thereby further improve safety of the plasma ignition device and to make the plasma ignition device further compact in size.

The plasma ignition device 1 of this embodiment has the structure in which the respective circuit components shown in FIG. 1 are disposed in a housing section 520 of a roughly tubular shape fixed in the plug hole 730 of the engine 70, or a head case 510 provided outside the plug hole 730 so as to be coupled to the housing section 520, or a case 23 of a power supply adjusting section including the DC/DC converter 22 and the capacitor $C_2$ and connected to the head case 510 as shown in FIG. 7.

The housing section 520 is formed with a thread section 521 at its outer periphery on its base end side. The housing section 520 is screw-connected to the cylinder head 701 at the screw section 521, and grounded to the cylinder head 701. The housing section 520 is provided with an insulating elastic member of a tubular shape as a plug cap 522 at its front end side. The plug cap 522 is fitted so as to cover the insulator head section 122 of the ignition plug 10 mounted to the cylinder head 701 of the engine 70.

In the high voltage area $A_1$ inside the housing section 520, the step-up coil 31, rectifying element 33, noise absorbing resistor 34 and rectifying element 430 are disposed in a state of resisting a high voltage of up to 40 kV, and having electrical conduction to the center electrode 11 within the plug cap 522.

The housing section 520 may be made of metal such as stainless steel formed in a tubular shape, or an insulating thermoplastic resin such as PET (polybutylene terephthalate) formed in a tubular shape and grounded to the cylinder head 701 through a metal plating or a grounding terminal provided at a part of its surface, if insulation sufficient for the high voltage area $A_1$ can be ensured.

By disposing the step-up coil 31 in the housing section 520, it is possible to shorten the length of a wire laid between the secondary coil of the step-up coil 31 applied with a high voltage of from 10 kV to 40 kV and the ignition plug 10.

In the next high voltage area $A_2$ inside the head case 510, the step-up coil 401, capacitor $C_1$, switching elements 32 and 402, and rectifying elements 403 and 412 are disposed in a state of resisting a high voltage of up to 2 kV.

Since the head case 510 is coupled to the housing section 520, it is grounded to the cylinder head 701 through the housing section 520. The switching elements 32 and 402, secondary coils of the step-up coils 31 and 401 and capacitor C1 are grounded to the cylinder 701 through the head case 510.

The head case 510 may be made of metal such as stainless steel formed in a box shape, or an insulating thermoplastic resin such as PBT formed in a box shape and grounded to the cylinder head 701 through the housing section 520 at a metal plating or a grounding terminal provided at a part of its surface, if insulation sufficient for the next high voltage area $A_2$ can be ensured.

By disposing the step-up coil 401 and the capacitor $C_1$ in the head case 510, it is possible to shorten the distance between the next high voltage area $A_2$ and the ignition plug 10 to the second to that of the high voltage area $A_1$.

In this embodiment, since the capacitor $C_1$ is fully charged with a high voltage in a short time, it is possible to reduce the design insulation level compared to the conventional case where the capacitor for plasma discharge is charged by being always applied with a high voltage.

The pulse shaping circuit 50 is controlled in accordance with the ignition signal IGt received from the ECU 60 through a connector 511 provided in the head case 510.

Inside the case 23 of the power supply adjusting section as the next-to-next high voltage area $A_3$, the DC/DC converter 22 and the capacitor $C_2$ are disposed in a state of resisting a high voltage up to 600 V. The DC/DC converters 22 and the capacitors $C_2$ of the respective cylinders may be disposed in the same case 23 of the power supply adjusting section.

By setting the charge voltage $V_{C2}$ applied to the capacitor $C_2$ by the DC/DC converter 2 below 350 V, it is possible to reduce the design insulation level of the wire for connection between the case 23 of the power adjusting section and the head case 510 because a partial discharge becomes more difficult compared to the conventional case where the capacitor for plasma discharge is charged by being always applied with a high voltage. In addition, also the withstand voltage of the wiring of the DC/DC converter 2 can be reduced because there is little possibility of occurrence of a partial discharge.

Figure 8:
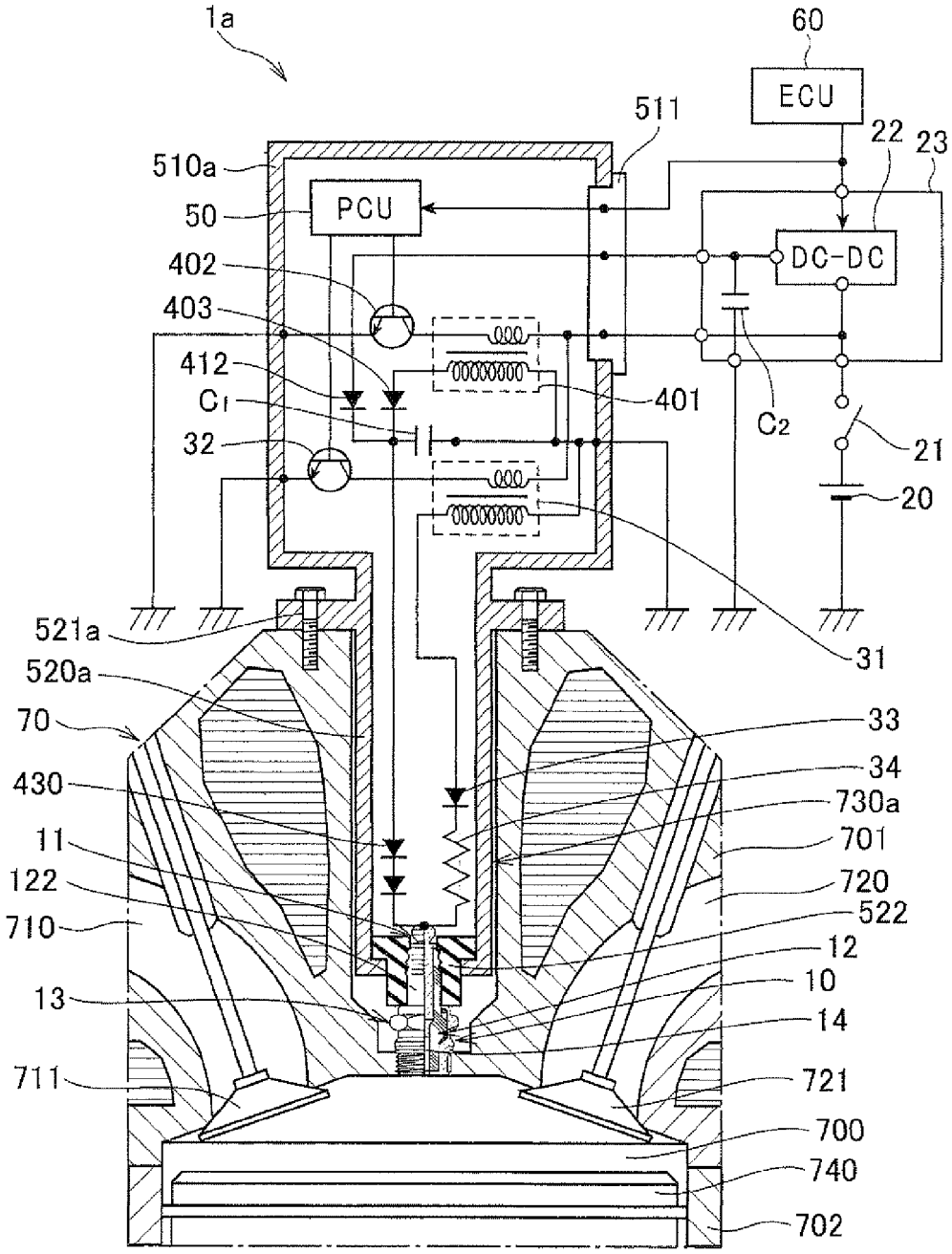
FIG. 8 is a first variant of the plasma ignition device 1 of the first embodiment of the invention.

Next, a first variant of the plasma ignition device 1 of the first embodiment is described with reference to FIG. 8. In FIG. 8, the parts which are the same as those shown in the previously described figures are given the same reference numerals or characters, and are not described again, except as necessary for an understanding of the present variant.

In this variant, unlike the first embodiment shown in FIG. 7, a housing section 520*a* houses a wire for carrying a breakdown discharge current laid between the secondary coil of the step-up coil 31 and the ignition plug 10, the rectifying element 33, the noise absorbing resistor 34, a wire for carrying a plasma discharge current laid between the capacitor $C_1$ and the ignition plug 10, and the rectifying element 430, and a head case 510*a* house the step-up coil 31. By disposing the step-up coil 31 inside the head case 510*a*, it becomes possible to make the housing section 520*a* small in diameter so as to be suitable to a small-diameter plug hole 730*a*, maintaining its insulation to the high voltage. In addition, it makes it possible to suppress magnetic interference by assembling the cores of the step-up coils 31 and 401 as a closed magnetic path.

In the first embodiment, the housing section 520 is screw-connected to the engine head 71 at its thread section 521. However, the head case 510*a* may be provided with a collar section 521*a* to be screw-connected to the engine head 71 as shown in FIG. 8.

Figure 9:
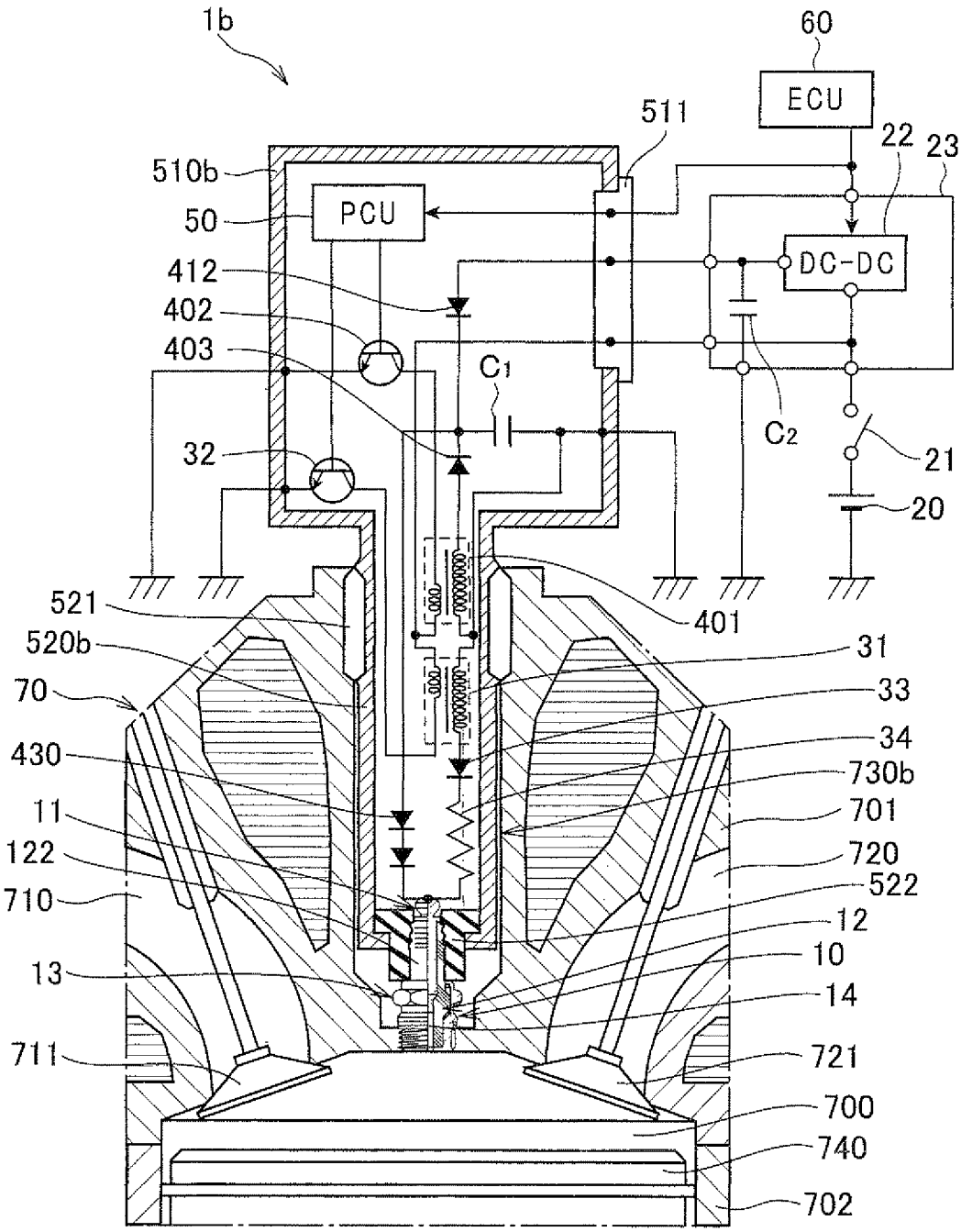
FIG. 9 is a second variant of the plasma ignition device 1 of the first embodiment of the invention.

Next, a second variant of the plasma ignition device 1 of the first embodiment is described with reference to FIG. 9. When a plug hole 730*b* is sufficiently large, both the step-up coil 31 and the step-up coil 401 may be disposed in a housing section 520*b*.

In this case, a head case 510*b* can be made small in size so that it can be mounted to the engine easily.

Figure 10:
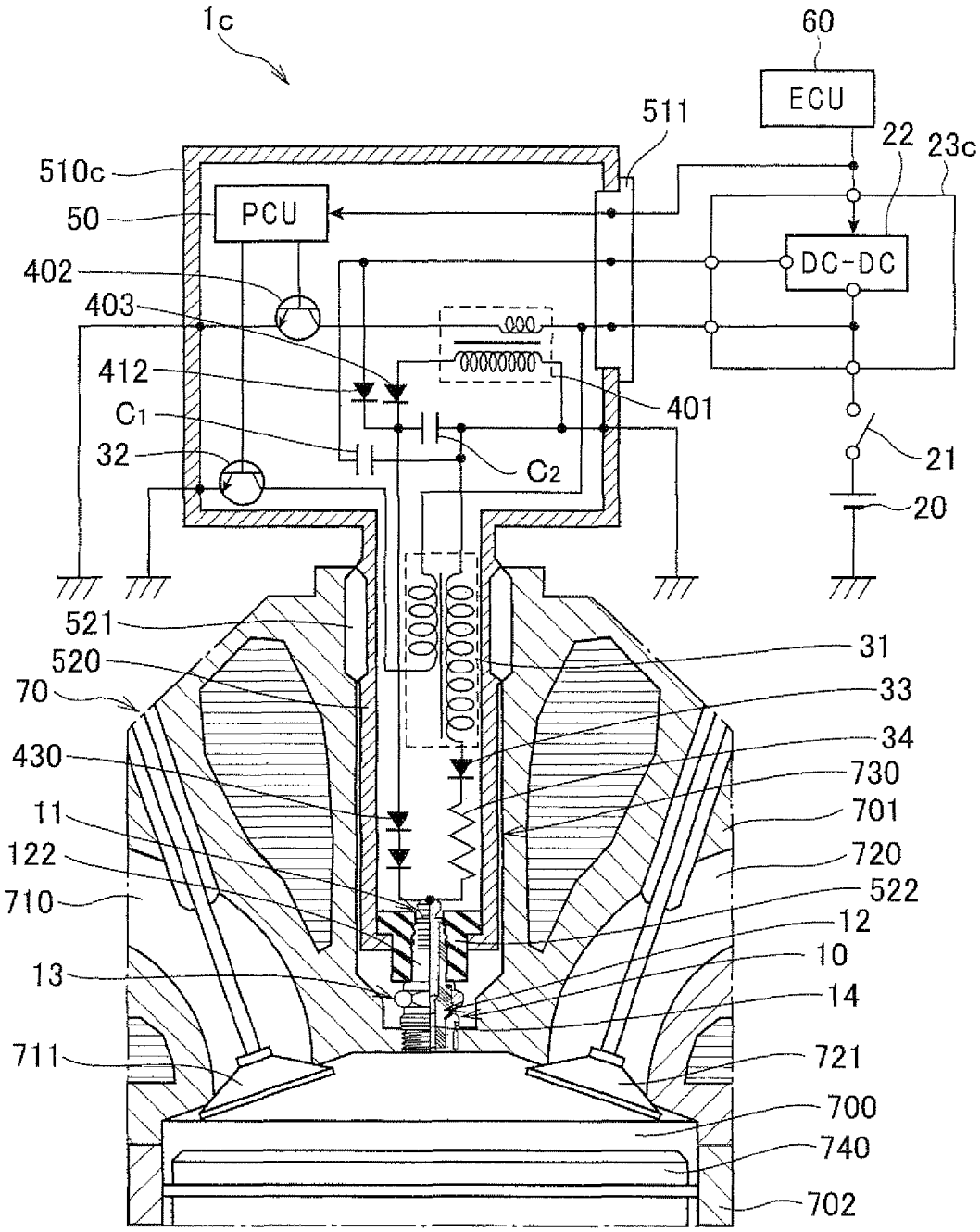
FIG. 10 is a third variant of the plasma ignition device 1 of the first embodiment of the invention.

Next, a third variant of the plasma ignition device 1 of the first embodiment is described with reference to FIG. 10. In this variant, the capacitor $C_2$ is disposed inside a head case 510*c*. According to this variant, since both the capacitor $C_1$ and the capacitor $C_2$ are disposed inside the head case 510*c*, and accordingly the distance between them and the ignition plug 10 is constant irrespective of the mounting position of the case 23 of the power supply adjusting section, the plasma discharge current $I_{PL}$ is constant, ensuring stable ignition.

Figure 11:
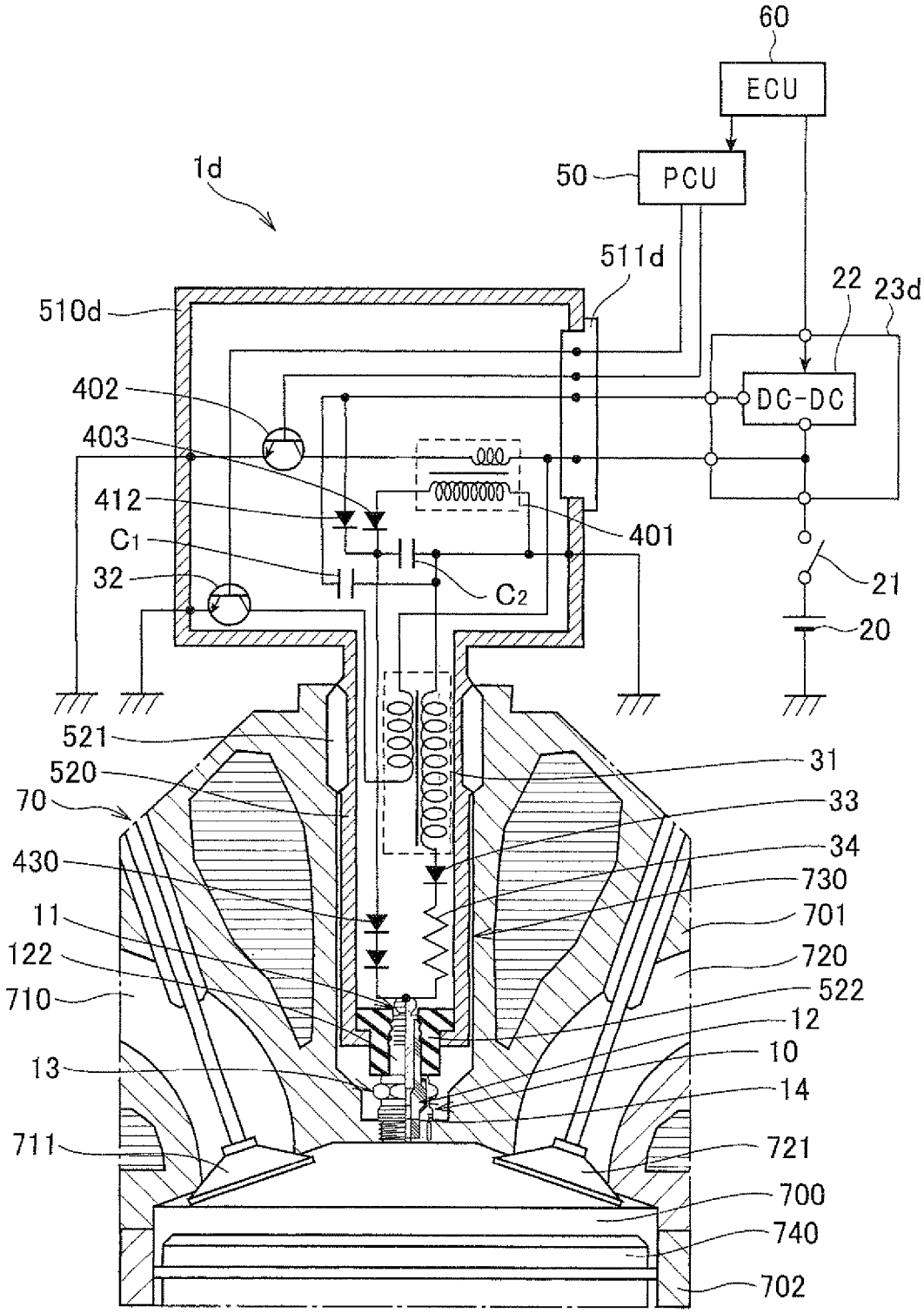
FIG. 11 is a fourth variant of the plasma ignition device 1 of the first embodiment of the invention.

Next, a fourth variant of the plasma ignition device 1 of the first embodiment is described with reference to FIG. 11. In this variant, the pulse shaping circuit 50 is disposed outside a head case 510*d*, and the switching elements 32 and 402 disposed inside the head case 510*d* are connected to the pulse shaping circuit 50 through a connector 511*d*. According to this variant, the switching elements, rectifying elements and capacitors can be configured not as an integrated circuit but as standard discrete components stable in performance, without increasing the size of the head case 510*d* by disposing the pulse shaping circuit 50 outside the head case 510*d*.

Since the signals passing through the pulse shaping circuit 50 are control signals, the pulse shaping circuit 50 may be disposed inside the case 23 of the power adjusting section or the ECU 60.

For example, when the open/close signals $SW_1$ and $SW_2$ are generated by the microcomputer of the ECU 60, the switching elements 32 and 402 can be on/off controlled from the ECU 60 by addition of a few components.

As explained above, according to the first embodiment in which a plurality of different design insulation levels are adopted in view of a small installation space of a vehicle, it becomes possible to provide a compact plasma ignition device capable of preventing false discharge and plasma-dropout phenomenon from occurring.

Figure 12:
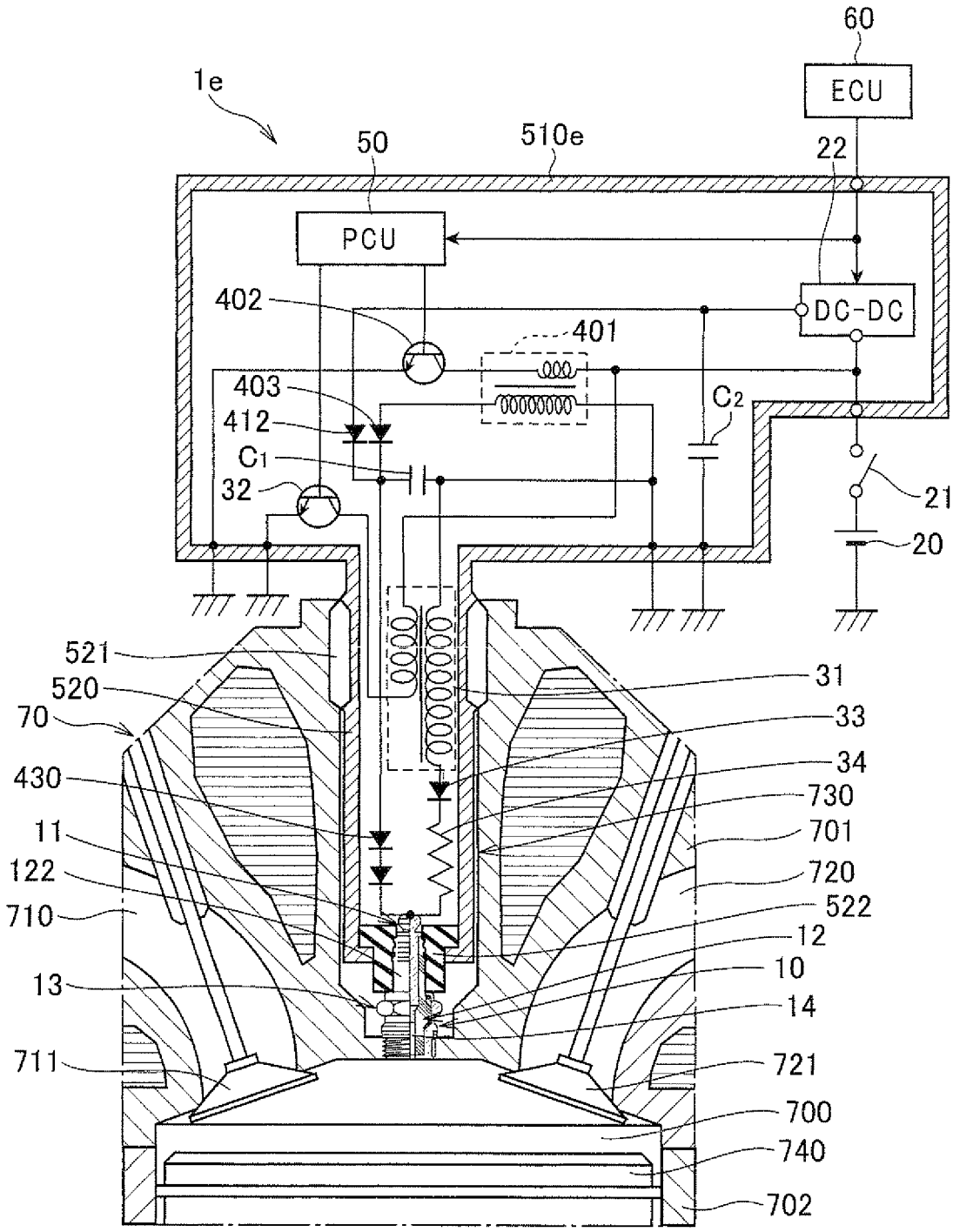
FIG. 12 is a modification of the plasma ignition device 1 of the first embodiment of the invention.

When a plasma ignition device 1*e* of this embodiment is used for an cogeneration system where its engine has a relatively large space for installing an ignition device, the DC/DC converter 22, breakdown discharge circuit 30, plasma discharge circuit 40 and pulse shaping circuit 50 may be disposed collectively inside a head case 510*e* as shown in FIG. 12. This configuration makes it possible to further increase the noise reduction effect, to thereby further stably perform ignition.

Second Embodiment

Figure 13:
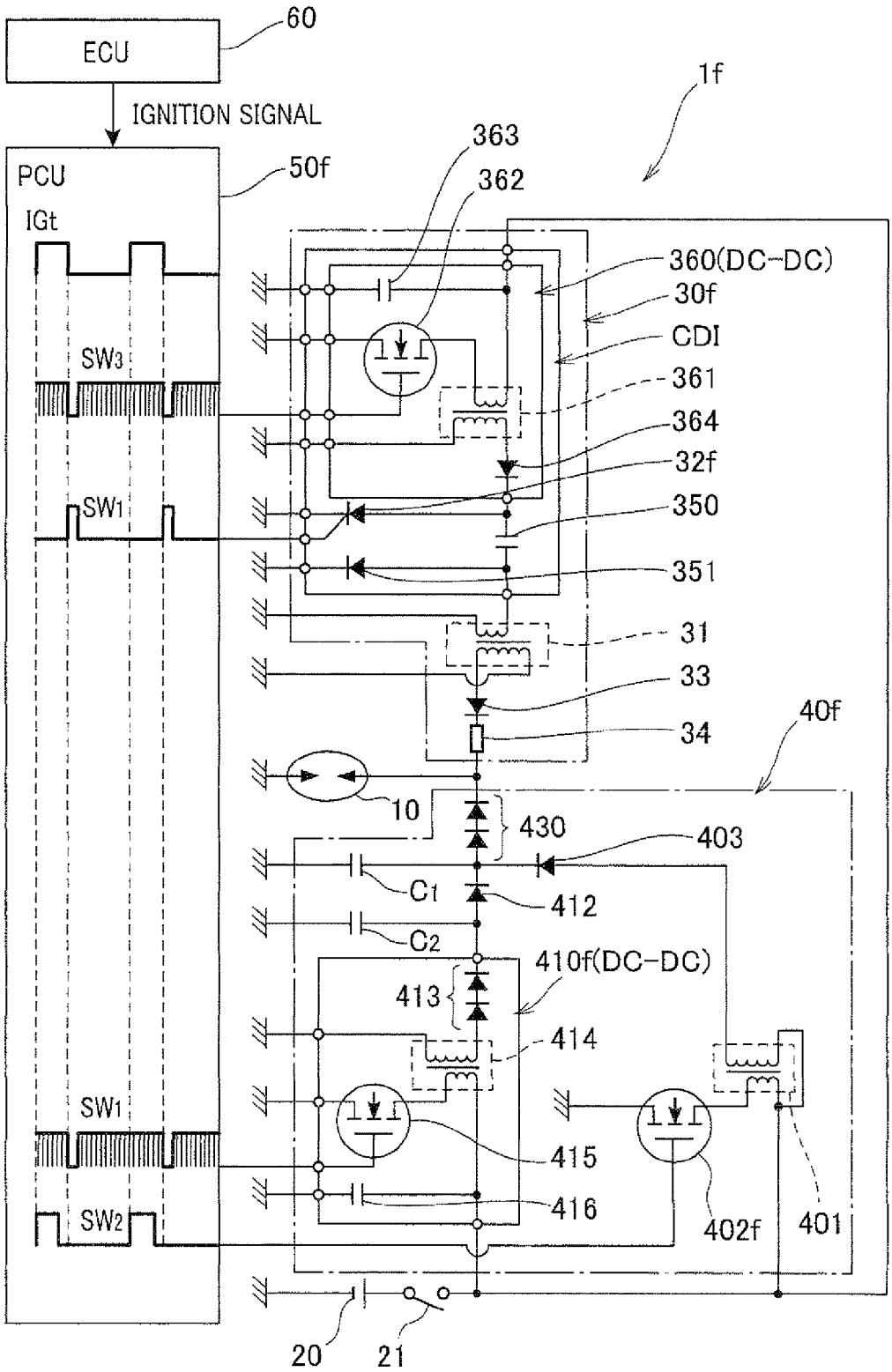
FIG. 13 is a circuit diagram of a plasma ignition device 1*f* of a second embodiment of the invention.

Next, a plasma ignition device if of a second embodiment of the invention is described with reference to FIGS. 13 and 14. As shown in FIG. 13, in this embodiment, a breakdown discharge circuit 30*f* includes a CDI unit, the step-up coil 31, the rectifying element 33 and the noise absorbing resistor 34.

The CDI unit includes a DC/DC converter 360, a switching element 32*f*, a capacitor 350 and a rectifying element 351. One terminal of the primary coil of the step-up coil 31 is connected to an output terminal of the CDI unit, and the other terminal is grounded. One terminal of the secondary coil of the step-up coil 31 is connected to the ignition plug 10 through the rectifying element 33 and the noise absorbing resistor 34, and the other terminal is grounded.

The DC/DC converter 360 includes a capacitor 363, a switching element 362 such as a MOSFET, a coil 361 and a rectifying element 364.

The breakdown discharge circuit 30 of the plasma ignition device of the first embodiment is of the IDI type (Inductive Discharge Ignition type) where a high voltage is generated in the secondary coil of the step-up coil 31 by changing a current flowing through the primary coil by use of the switching element 32 such as a transistor. On the other hand, in this embodiment, the breakdown discharge circuit 30*f* is of the CDI type (Capacity Discharge Ignition type) where a high voltage is generated in the secondary coil of the step-up coil 31 by rapidly changing magnetic flux flowing through the magnetic path of the step-up coil 31 by discharging charges accumulated in the capacitor 350 of the CDI unit to the primary coil of the step-up coil 31.

In this embodiment, the capacitor 350 of the CDI unit is applied with a voltage which the DC/DC converter 360 generates by stepping up the voltage of the power supply 20, in order to shorten the time period of a breakdown discharge and increase a discharge current.

In this embodiment, a plasma discharge circuit 40*f* includes the step-up coil 401 to step up the power supply voltage, a switching element 402*f* to open and close the step-up coil 401, the rectifying element 403 to rectify a discharge current flowing from the step-up coil 401, the capacitor $C_1$ charged with a discharge current flowing from the step-up coil 401, a DC/DC converter 410*f* to step up and regulate the voltage of the power supply 20, the capacitor $C_2$ charged with the voltage outputted from the DC/DC converter 410*f*, the rectifying element 412 to rectify a current flowing from the capacitor $C_2$, and the rectifying element 430 to rectify a plasma current discharged from the capacitor $C_2$.

In this embodiment, a pulse shaping circuit 50*f* generates the open/close signal $SW_1$ to open and close the switching element 32*f* of the breakdown discharge circuit 30*f*, an open/close signal $SW_3$ to open and close the switching element 362, the open/close signal $SW_2$ to open and close the switching element 402*f* of the plasma discharge circuit 40*f*, and a open/close signal SW4 to open and close a switching element 415.

In FIG. 14A, (a) shows occurrence timings of the ignition signal IGt, (b) shows variation with time of the open/close signal $SW_3$, (c) shows variation with time of the voltage across the capacitor 350, (d) shows occurrence timings of the open/close signal $SW_1$, (e) shows occurrence timings of the open/close signal $SW_2$, (f) shows variation with time of the primary current $Ipr_{401}$ of the step-up coil 401, (g) shows variation with time of the charge voltage $V_{C1}$, (h) shows occurrence timings of the open/close signal $SW_4$, and (i) shows variation with time of the charge voltage $V_{C2}$ with which the capacitor $C_2$ is charged.

Figure 14:
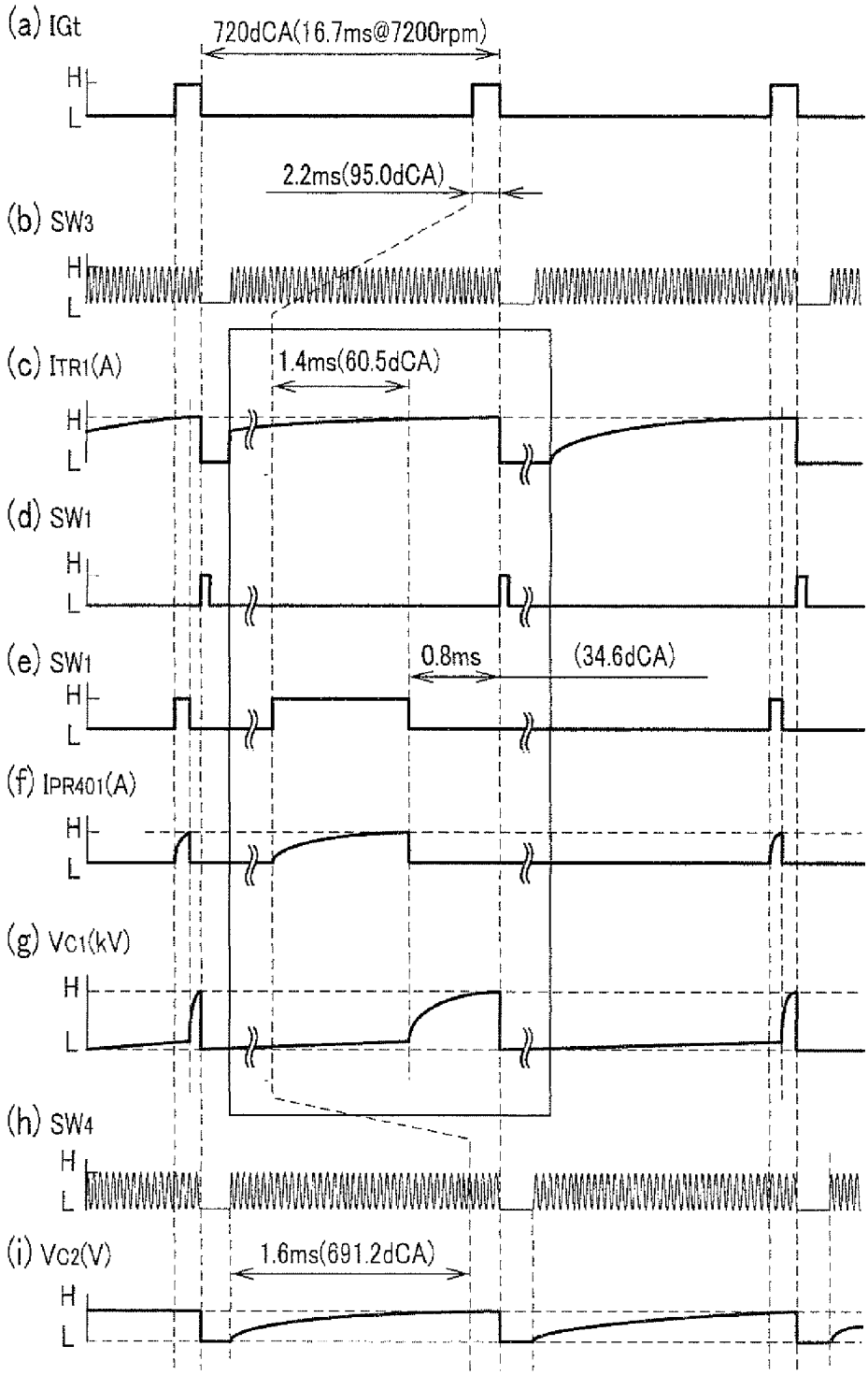
FIG. 14 is a time chart showing timings of various signals in the plasma ignition device 1*f* of the second embodiment of the invention.

As shown in FIG. 14, the switching element 32*f* is opened and closed in accordance with the open/close signal $SW_1$ which the pulse shaping circuit 50 generates in accordance with the ignition signal IGt to cause flux change in the step-up coil 31 to thereby generate a high voltage in the secondary coil of the step-up coil 31. The open/close signal $SW_2$ is turned on and off immediately before the ignition signal IGt is turned off in order that charging of the capacitor $C_1$ is completed before the high voltage is generated. This embodiment enables preventing both a false discharge and the plasma-dropout phenomenon from occurring like the first embodiment.

In this embodiment, the open/close signals $SW_1$ and $SW_2$ are generated by the pulse shaping circuit 50, however, they may be generated by the ECU 60 without use of the ignition signal IGt.

In this embodiment where the pulse shaping circuit 50 generates the open/close signals $SW_1$ and $SW_2$ in accordance with the ignition signal IGt outputted from the ECU 60, the open/close signals $SW_1$ and SW and the ignition signal IGt have to be corrected depending on the power supply voltage. However, when the pulse shaping circuit 50 is disposed outside the ECU 60, since the detected value of the power supply voltage varies causing correction amounts to vary, the time difference t between fall timings of the open/close signals $SW_1$ and $SW_2$ cannot be kept constant.

It is possible to keep the time difference t constant if the ECU 60 directly generates the open/close signals $SW_1$ and $SW_2$.

However, for the ECU 60 to directly generate the open/close signals $SW_1$ and $SW_2$, the number of lines for connection between the ECU 60 and the pulse shaping circuit 50 has to be increased from one to two. This increases the manufacturing cost. A third embodiment of the invention described below can eliminate this problem.

Third Embodiment

Figure 15:
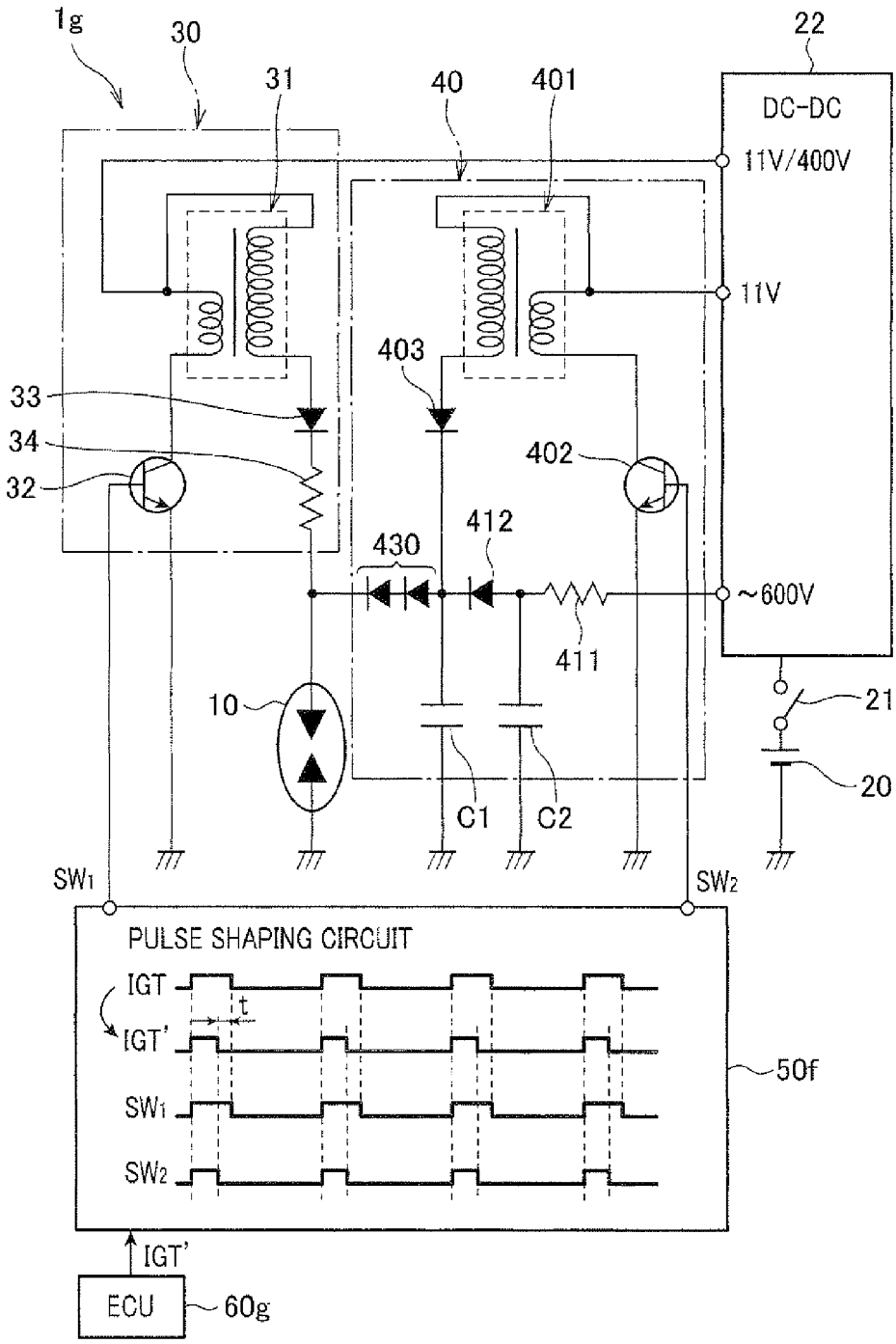
FIG. 15 is a circuit diagram of a plasma ignition device 1*g* of a third embodiment of the invention.

FIG. 15 is a circuit diagram of a plasma ignition device 1*g* of the third embodiment of the invention. In the above first and second embodiments, the pulse shaping circuit 50 generates the open/close signals $SW_1$ and $SW_2$ in accordance with the ignition signal IGt generated by the ECU 60 in order to control the breakdown discharge voltage application and the plasma current discharge. However, this embodiment is configured such that an ECU 60*g* generates a second ignition signal IGt' which falls earlier by a predetermined time t1 than the ignition signal IGt in order that ignition is carried out the predetermined time t1 after the second ignition signal IGt' falls.

Upon receiving the second ignition signal IGt', the pulse shaping circuit 50*g* generates the open/close signal $SW_2$ having the same timing as the second ignition signal IGt', and generates the open/close signal $SW_1$ such that it falls the predetermined time t1 later than the fall of the second ignition signal IGt' and the open/close signal $SW_2$.

In the first and second embodiments, since the timings at which the ignition signal IGt rises advance or delay depending on variation of the power supply voltage, the ignition signal IGt and the open/close signals $SW_1$ and $SW_2$ have to be corrected depending on the power supply voltage. However, since this requires complicated correction computation, ignition timings may differ from desired ones depending on the running state of the engine.

While, according to this embodiment where the second ignition signal IGt' is generated and corrected depending on variation of the power supply voltage, since the open/close signals $SW_1$ and $SW_2$ are self-corrected, the time difference between the falls of the open/close signals $SW_1$ and $SW_2$ can be kept constant without correcting the open/close signals $SW_1$ and $SW_2$ individually. Accordingly, even when the predetermined time t1 becomes shorter, it is possible to perform ignition stably, because the charge voltage does not decrease.

Fourth Embodiment

Next, a plasma ignition device 1*h* of a fourth embodiment of the invention is explained.

Figure 16:
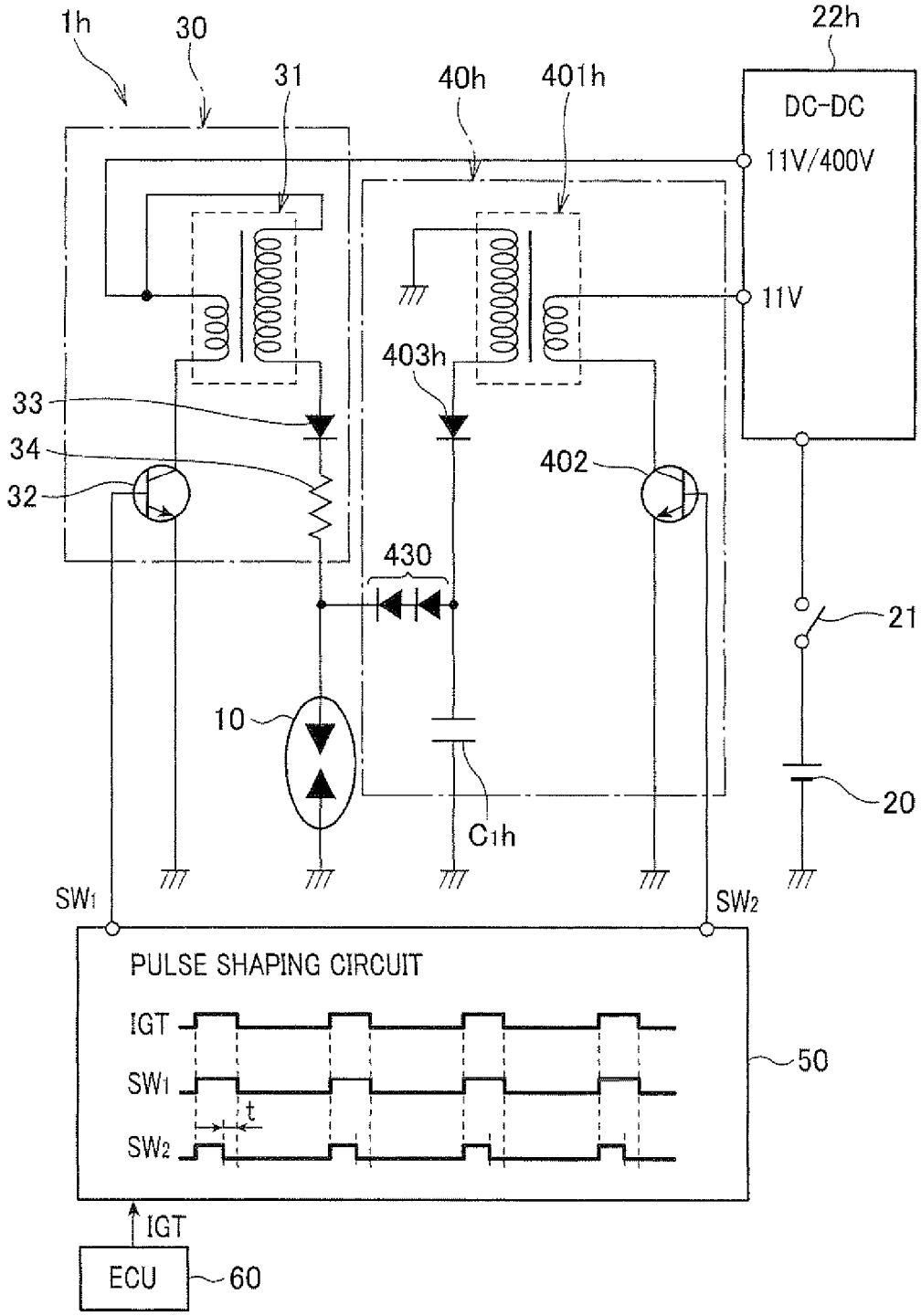
FIG. 16 is a circuit diagram of a plasma ignition device 1*h* of a fourth embodiment of the invention.
Figure 17:
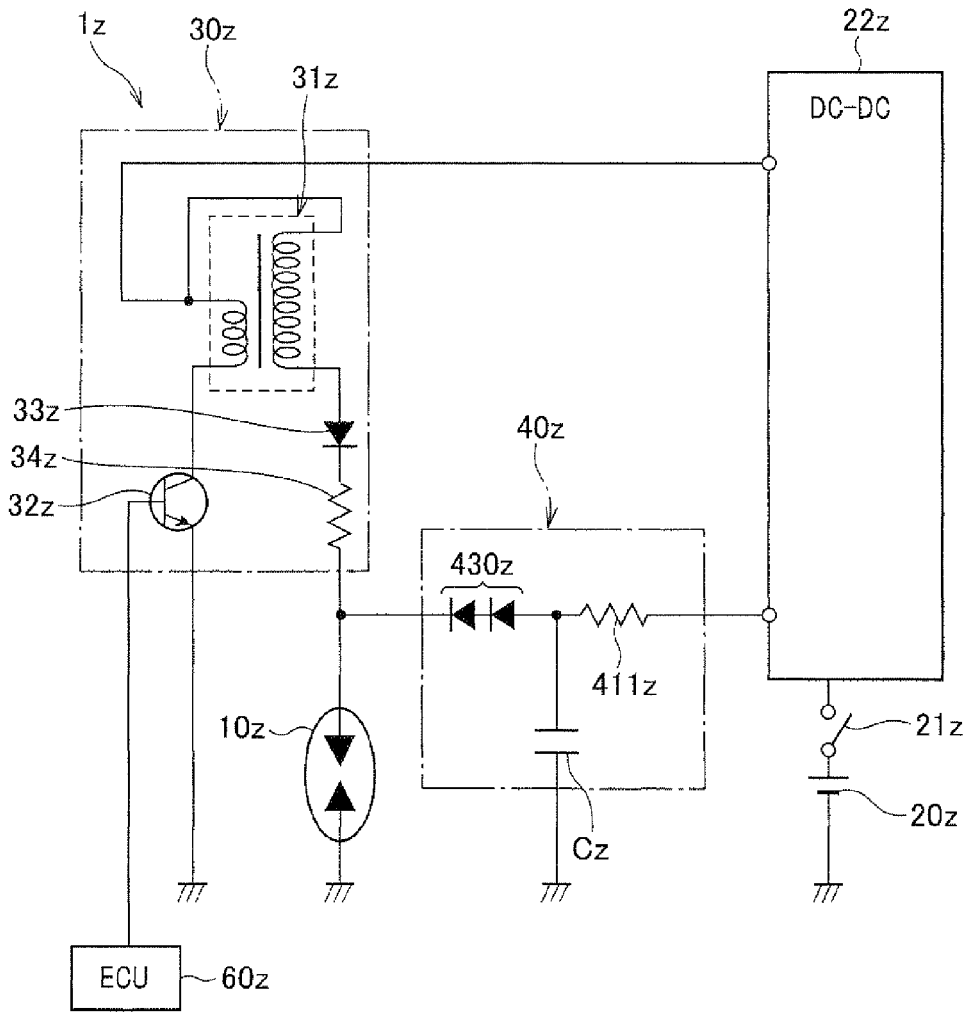
FIG. 17 is a circuit diagram of a conventional plasma ignition device.
Figure 18A:
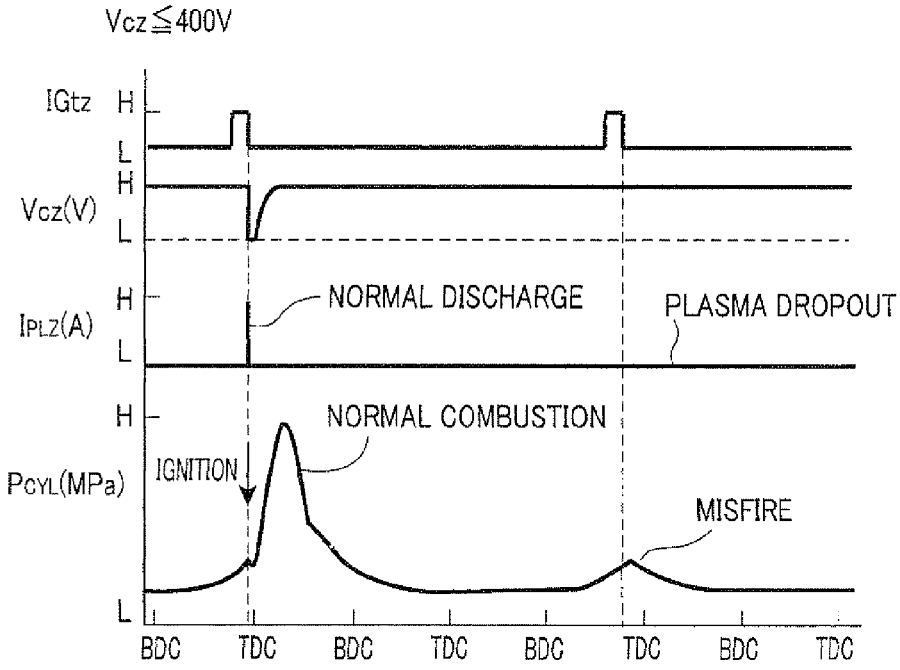
FIG. 18A is a time chart for explaining problems in the conventional plasma ignition device when the charge voltage is below 400V.
Figure 18B:
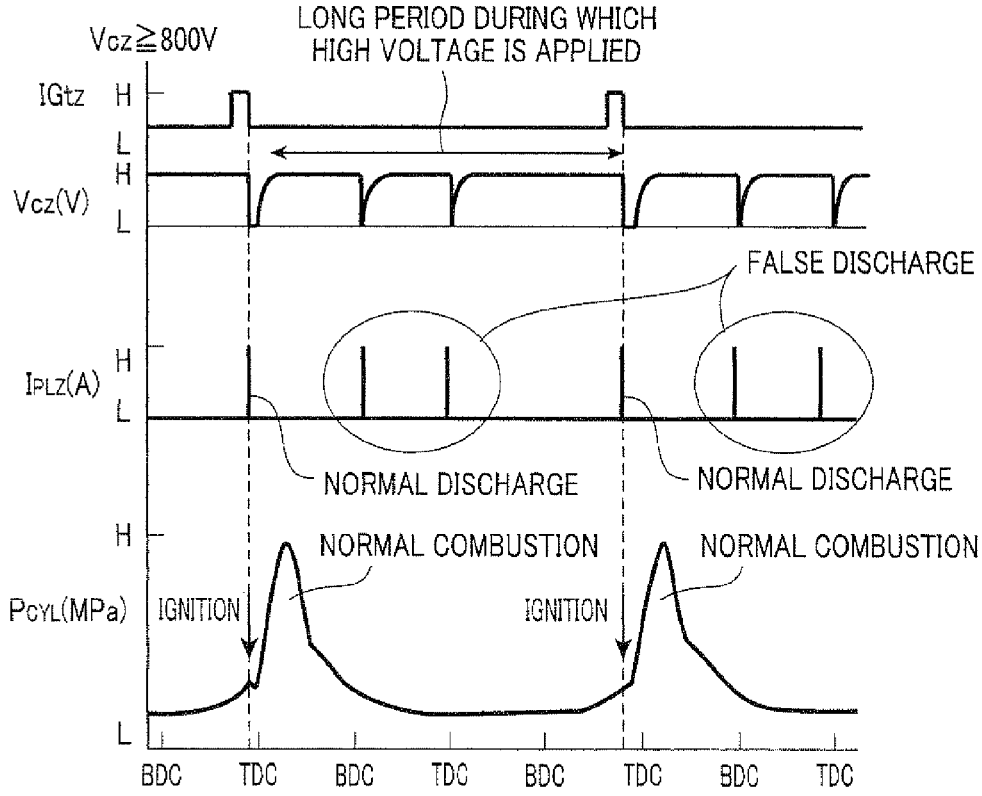
FIG. 18B is a time chart for explaining problems in the conventional plasma ignition device when the charge voltage is above 800 V.

In the foregoing embodiments, two capacitors ($C_1$ and $C_2$) are used so that the capacitance of one of the capacitors included in the plasma discharge circuit 40 can be small in view of a limited installation space of a vehicle. However, when the plasma ignition device of the invention is used where there is no such limit to the installation space, for example, if it is used for a cogeneration system, these capacitors may be replaced by a single capacitor $C_{1h}$ as shown in FIG. 16.

The above explained preferred embodiments are exemplary of the invention of the present application which is described solely by the claims appended below. It should be understood that modifications of the preferred embodiments may be made as would occur to one of skill in the art.

What is claimed is:

1. A plasma ignition device comprising:

an ignition plug mounted on an combustion engine;

a breakdown discharge circuit configured to generate a first voltage by stepping up a first power supply voltage and apply the generated first voltage to the ignition plug to cause a breakdown discharge in a discharge space in the ignition plug; and a plasma discharge circuit configured to accumulate electric energy supplied from a power supply and apply the accumulated electric energy to the ignition plug as a current to bring a gas in the discharge space into a plasma state so that the gas in the plasma state is injected to a combustion chamber of the combustion engine during the breakdown discharge to cause ignition;

wherein the plasma discharge circuit includes an energy accumulating section, and an energy supplying section configured to supply the electric energy to the energy accumulating section during a time period immediately before the breakdown discharge circuit applies the first voltage to the ignition plug, wherein the energy supplying section includes a first step-up coil comprising a first primary coil applied with a second power supply voltage and a first secondary coil, and a first switching element to open and close the first primary coil to generate a second voltage in the first secondary coil, wherein the energy accumulating section includes first and second capacitors connected in parallel to each other through a rectifying element, the first capacitor being charged with the second voltage for a first time period, the second capacitance being charged with a third power supply voltage lower than the second voltage for a second time period, and wherein the first capacitor has a first capacitance, and the second capacitor has a second capacitance larger than the first capacitance, the second time period being longer than the first time period.

2. The plasma ignition device according to claim 1, wherein the first capacitance is in a range of from 0.001 μF to 0.1 μF.

3. The plasma ignition device according to claim 1, wherein the second voltage is in a range of from 800 V to 2 kV.

4. The plasma ignition device according to claim 1, wherein the second capacitance is in a range of from 0.5 μF to 5 μF.

5. The plasma ignition device according to claim 1, wherein the third power supply voltage is below 600 V.

6. The plasma ignition device according to claim 1, wherein the third voltage is below 350 V.

7. The plasma ignition device according to claim 1, wherein the breakdown discharge circuit includes a second step-up coil comprising a second primary coil applied with the first power supply voltage and a second secondary coil, and a second switching element to open and close the second primary coil to generate the first voltage in the second secondary coil.

8. The plasma ignition device according to claim 1, wherein the first voltage is in a range of from 10 kV to 40 kV.

9. The plasma ignition device according to claim 7, further comprising a pulse shaping circuit configured to generate, in accordance with an ignition signal which an external ECU generates in accordance with a running state of the engine, a first open/close pulse signal to turn on and off the first switching element, and a second open/close pulse signal to turn on and off the second switching element.

10. The plasma ignition device according to claim 1, wherein the plasma ignition device is sectioned into a first area having a withstand voltage of from 10 kV to 40 kV, a second area having a withstand voltage of from 800 V to 2.5 kV, and a third area having a withstand voltage below 600 V.

* * * * *